US012759681B2

(12) United States Patent
Wacker

(10) Patent No.: US 12,759,681 B2
(45) Date of Patent: Oct. 13, 2026

(54) ASSEMBLIES FOR BOAT LIFTS

(71) Applicant: Great Lakes Entry Systems, Inc., Whitmore Lake, MI (US)

(72) Inventor: David Wacker, Whitmore Lake, MI (US)

(73) Assignee: Great Lakes Entry Systems, Inc.

( * ) Notice: Subject to any disclaimer, the term of this patent is extended or adjusted under 35 U.S.C. 154(b) by 209 days.

(21) Appl. No.: 18/664,353

(22) Filed: May 15, 2024

(65) Prior Publication Data

US 2024/0383586 A1 Nov. 21, 2024

Related U.S. Application Data

(60) Provisional application No. 63/503,026, filed on May 18, 2023.

(51) Int. Cl.
*B63C 3/06* (2006.01)
*B63C 3/12* (2006.01)

(52) U.S. Cl.
CPC . *B63C 3/06* (2013.01); *B63C 3/12* (2013.01)

(58) Field of Classification Search
CPC ..... B63C 3/06; B63C 3/12
See application file for complete search history.

(56) References Cited

U.S. PATENT DOCUMENTS 5,593,247 A * 1/1997 Endres ..... E02C 5/00 114/44
5,769,568 A * 6/1998 Parkins ..... B63C 3/06 114/44
7,059,803 B2 6/2006 Floe et al.
7,117,805 B2 * 10/2006 Shackelford, Jr. ..... B63C 3/06 405/3
7,383,781 B1 * 6/2008 Griffin ..... B63C 3/06 405/1
7,850,147 B1 * 12/2010 Fox ..... B66D 1/14 254/296
7,856,936 B2 * 12/2010 Nemethy ..... B66F 7/02 405/3

(Continued)

OTHER PUBLICATIONS

BH-USA Everything for Your Dock & PIER, www.BoatLifts4Less.com (50 pgs.).

(Continued)

*Primary Examiner* — Frederick L Lagman
(74) *Attorney, Agent, or Firm* — Meunier Carlin & Curfman LLC

(57) ABSTRACT

Boat lift assemblies and methods. In an example embodiment, a free-standing boat lift assembly can include a width-adjustable outer frame defined by vertical towers that support upper horizontal support beams, and one or more cable winding shafts mounted to one or more of the upper horizontal support beams. In some examples, the cable winding shaft(s) is/are mounted to the upper support beam (s) with one or more multi-part bearing blocks. In an example embodiment, a bearing block portion of a boat lift assembly can include a U-shaped shaft receiving recess and a cover plate. In some examples, the U-shaped shaft receiving recess defines a grease valley at a bottom of the U-shape. In some examples, a cable retaining plate can be mounted to one or more bearing blocks to assist in retaining wound cable on a spool surrounding the cable winding shaft.

24 Claims, 25 Drawing Sheets

(56) References Cited

U.S. PATENT DOCUMENTS

| | | | | |
|---|---|---|---|---|
| 8,002,473 | B2 | 8/2011 | Becker et al. | |
| 8,727,661 | B2 * | 5/2014 | Heller | G05B 19/106 405/1 |
| 9,926,053 | B1 * | 3/2018 | Ascencio | B63C 3/14 |
| 10,145,121 | B1 | 12/2018 | Devitt | |
| D876,670 | S | 2/2020 | Devitt | |
| D877,933 | S | 3/2020 | Devitt | |
| D877,934 | S | 3/2020 | Devitt | |
| 11,027,802 | B1 | 6/2021 | Devitt | |
| 12,030,602 | B2 * | 7/2024 | Golden | B63C 3/06 |
| 2004/0035343 | A1 * | 2/2004 | Floe | B63C 3/06 114/51 |
| 2005/0274311 | A1 * | 12/2005 | Shackelford | B63C 3/06 114/44 |
| 2010/0239371 | A1 | 9/2010 | Brown | |
| 2014/0017009 | A1 | 1/2014 | Hey | |
| 2017/0043849 | A1 | 2/2017 | Brown | |
| 2017/0268569 | A1 | 9/2017 | Ookuma et al. | |
| 2022/0177089 | A1 * | 6/2022 | Golden | B63C 3/06 |
| 2022/0355909 | A1 * | 11/2022 | Genovese | B66F 7/28 |
| 2022/0371860 | A1 * | 11/2022 | Fox | F16H 57/0006 |
| 2024/0124110 | A1 * | 4/2024 | Cormier | B63C 3/06 |

OTHER PUBLICATIONS

IMM-2021-Catalog-Update-v2-Web-June-2021, www.iqboatlifts.com (32 pgs.).
Installation Instructions, Fix Marine Supply, Cover Aug. 10, 2018 (8 pgs.).
ShoreStation Boat Lifts, shorestation.com (13 pgs.).
X2 Great Drive Catalog as of Mar. 2018 (14 pgs.).
Image of an assembly for a boat lift apparatus, admitted as prior art as of May 17, 2023.

* cited by examiner

ASSEMBLIES FOR BOAT LIFTS

CROSS-REFERENCE TO RELATED APPLICATIONS

This patent application claims the benefit of U.S. Provisional Application No. 63/503,026 filed May 18, 2023, the content of which application is hereby incorporated by reference in its entirety.

FIELD OF THE DISCLOSURE

The various embodiments of the present disclosure relate generally to mechanical lift units, and more particularly to boat lift systems, assemblies, and methods of assembly.

BACKGROUND

Boat lifts generate mechanical force to lower and raise boats into and out of bodies of water. A boat lift is positioned over a body of water and can support the weight of a boat, e.g., in a cradle of the boat lift. A driving system can be controlled mechanically and/or electronically to cause the cradle to move up and down to either lift the cradle and the boat out of the water or to lower the boat into the water.

SUMMARY

In general terms, the present disclosure is directed to improvements in boat lift assemblies.

In further general terms, the present disclosure is directed to improvements in methods of assembling boat lifts.

In further general terms, the present disclosure is directed to improvements in methods of disassembling boat lifts.

In further general terms, the present disclosure is directed to improvements in methods of repairing boat lifts.

In further general terms, the present disclosure is directed to improvements in methods of installing boat lifts in or over bodies of water.

In further general terms, the present disclosure is directed to improvements in methods of uninstalling a boat lift from one location and reinstalling the boat lift in another location.

In further general terms, the present disclosure is directed to improvements in methods of manufacturing boat lifts.

According to one aspect, an assembly for a boat lift includes: a frame, the frame extending from a bottom of the frame to a top of the frame parallel to a vertical axis, the frame including: four vertical members elongate parallel to the vertical axis, the vertical members including a first pair of vertical members and a second pair of vertical members; and four horizontal members elongate perpendicular to the vertical axis and coupled to the vertical members; a beam elongate perpendicular to the vertical axis and attached to two of the vertical members, the beam being positioned above the four horizontal members relative to the vertical axis; a bearing block attached to the beam; a cable winding shaft elongate perpendicular to the vertical axis received in the bearing block and rotatable relative to the beam; and a cradle coupled to the cable winding shaft and configured, by rotation of the cable winding shaft, to move up and down parallel to the vertical axis and relative to the frame, the cradle including a first pair of cradle members elongate perpendicular to the vertical axis and configured to abut a hull of a boat.

According to another aspect, a kit of parts for a boat lift includes: eight elongate members; an elongate beam; a bearing block; an elongate cable winding shaft; a cable; and a boat cradle, wherein the kit is configured to be assembled as an assembly of the boat lift that includes: a frame including the eight elongate members, the frame extending from a bottom of the frame to a top of the frame parallel to a vertical axis, the frame including: four of the elongate members positioned to be elongate parallel to the vertical axis to define a first pair of vertical members and a second pair of vertical members; another four of the elongate members positioned to be perpendicular to the vertical axis and coupled to the vertical members; the beam positioned to be elongate perpendicular to the vertical axis and above the four horizontal members relative to the vertical axis, the beam being attached to the first pair of vertical members or to the second pair of vertical members, the bearing block attached to the beam; the cable winding shaft positioned to be elongate perpendicular to the vertical axis, received in the bearing block, and rotatable relative to the beam; and the boat cradle being coupled to the cable winding shaft with the cable such that the cradle can move, by rotation of the cable winding shaft, up and down parallel to the vertical axis and relative to the frame.

According to another aspect, an assembly for a boat lift, includes: a frame extending from a bottom of the frame to a top of the frame parallel to a vertical axis, the frame including: four vertical members elongate parallel to the vertical axis, the vertical members including a first pair of vertical members and a second pair of vertical members; and four horizontal members elongate perpendicular to the vertical axis and coupled to the vertical members; a beam elongate perpendicular to the vertical axis and attached to two of the vertical members, the beam being positioned above the four horizontal members relative to the vertical axis; and a cradle configured to move up and down parallel to the vertical axis and relative to the frame, the cradle including a first pair of cradle members elongate perpendicular to the vertical axis and configured to abut a hull of a boat, wherein the first pair of vertical members is adjustably coupled to two of the four horizontal members to adjust a spacing between the first pair of the vertical members and the second pair of the vertical members.

According to another aspect, a kit of parts for a boat lift includes: eight elongate members; an elongate beam; coupling members; and a boat cradle; wherein the kit is configured to be assembled as an assembly of the boat lift that includes: a frame including the eight elongate members, and the coupling members, the frame extending from a bottom of the frame to a top of the frame parallel to a vertical axis, the frame including: four of the elongate members positioned to be elongate parallel to the vertical axis to define a first pair of vertical members and a second pair of vertical members; another four of the elongate members positioned to be perpendicular to the vertical axis and coupled to the vertical members; and the coupling members being positioned to adjustably couple at least the first pair of the vertical members or the second pair of the vertical members to two of the four horizontal members to adjust a spacing between the first pair of the vertical members and the second pair of the vertical members; and the beam positioned to be elongate perpendicular to the vertical axis and above the four horizontal members relative to the vertical axis, the beam being attached to the first pair of vertical members or to the second pair of vertical members; the boat cradle positioned to move up and down parallel to the vertical axis and relative to the frame, the cradle including a first pair of cradle members positioned to be elongate perpendicular to the vertical axis and configured to abut a hull of a boat.

According to another aspect, a kit of parts for a boat lift, includes: a bearing block, the bearing block including: a bearing block body defining a recess having an opening at a top of the bearing block body and configured to receive a cable winding shaft at a bottom of the recess; and a bearing block plate configured to be fastened to the top of the bearing block body, the bearing block plate including a flat surface configured to face the bottom of the recess and cover the opening when the bearing block plate is fastened to the bearing block body.

According to another aspect, a kit of parts for a boat lift includes: a bearing block, the bearing block including: a bearing block body defining a recess having an opening at a top of the bearing block body and configured to receive a cable winding shaft at a bottom of the recess; and a bearing block cover configured to be fastened to the top of the bearing block body, wherein the bearing block body includes a grease valley defined by a surface of the recess at the bottom of the U-shaped recess.

According to another aspect, a kit of parts for a boat lift includes a bearing block including a bearing block body defining a recess having an opening at a top of the bearing block body and configured to receive a cable winding shaft at a bottom of the recess; a bearing block cover configured to be fastened to the top of the bearing block body; and a cable retaining plate configured to be fastened to a top of the bearing block cover such that the cable retaining plate extends along the cable winding shaft beyond the bearing block cover when the cable winding shaft is positioned at the bottom of the recess.

According to another aspect, a method of assembling a boat lift, includes: fastening, with fasteners, bearing block bodies to a pair of beams having elongate dimensions parallel to an axis, the bearing block bodies defining shaft receivers having openings at tops of the shaft receivers; and inserting a rotatable cable winding shaft into the shaft receivers through the openings by lowering the cable winding shaft in a direction perpendicular to the axis.

Other aspects and features of embodiments will become apparent to those of ordinary skill in the art upon reviewing the following description of specific, exemplary embodiments in concert with the drawings. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Electrical boat lifts can include vertical boat lifts and hydraulic boat lifts. Vertical boat lifts typically include complex pulley systems with cables running throughout the system, including in the water. Typically, vertical boat lifts are not free-standing and are instead fastened to the tops of large permanent pilons driven into the river bed, lake bed, sea floor, and the like, making it challenging to repair, replace, or move the boat lift from one location to another. Examples of vertical boat lifts are described in U.S. Pat. No. 7,059,803 and U.S. Patent Publication No. 2010/0239371.

In typical hydraulic boat lift systems, the hydraulic lifting mechanisms are entirely underwater and function by pushing upwards to lift the boat from below. Submerging complex machinery in the water can cause the machinery to corrode and break down over relatively short periods of time, requiring frequent repair and/or replacement, with many types of maintenance being challenging to perform below the water surface (e.g., requiring diving equipment and human divers). An example of a hydraulic boat lift is described in U.S. Patent Publication No. 2014/0017009.

Typical electrical boat lifts include mechanical assemblies that are difficult and time consuming to assemble and disassemble. For example, electrical boat lifts can include cable a winding shaft that is mounted in bearing brackets. The bearing brackets receive the cable winding shaft and are typically single-piece components that are welded to beams of the boat lift assembly. Bearing brackets can wear out over time and through repeated use, and can otherwise become damaged. Because the bearing brackets are single-piece units welded to the beams, removing, replacing and/or repairing a faulty bearing bracket requires dismantling and/or discarding of a large portion of the boat lift assembly, at significant monetary, labor, and time costs.

Figure 1:
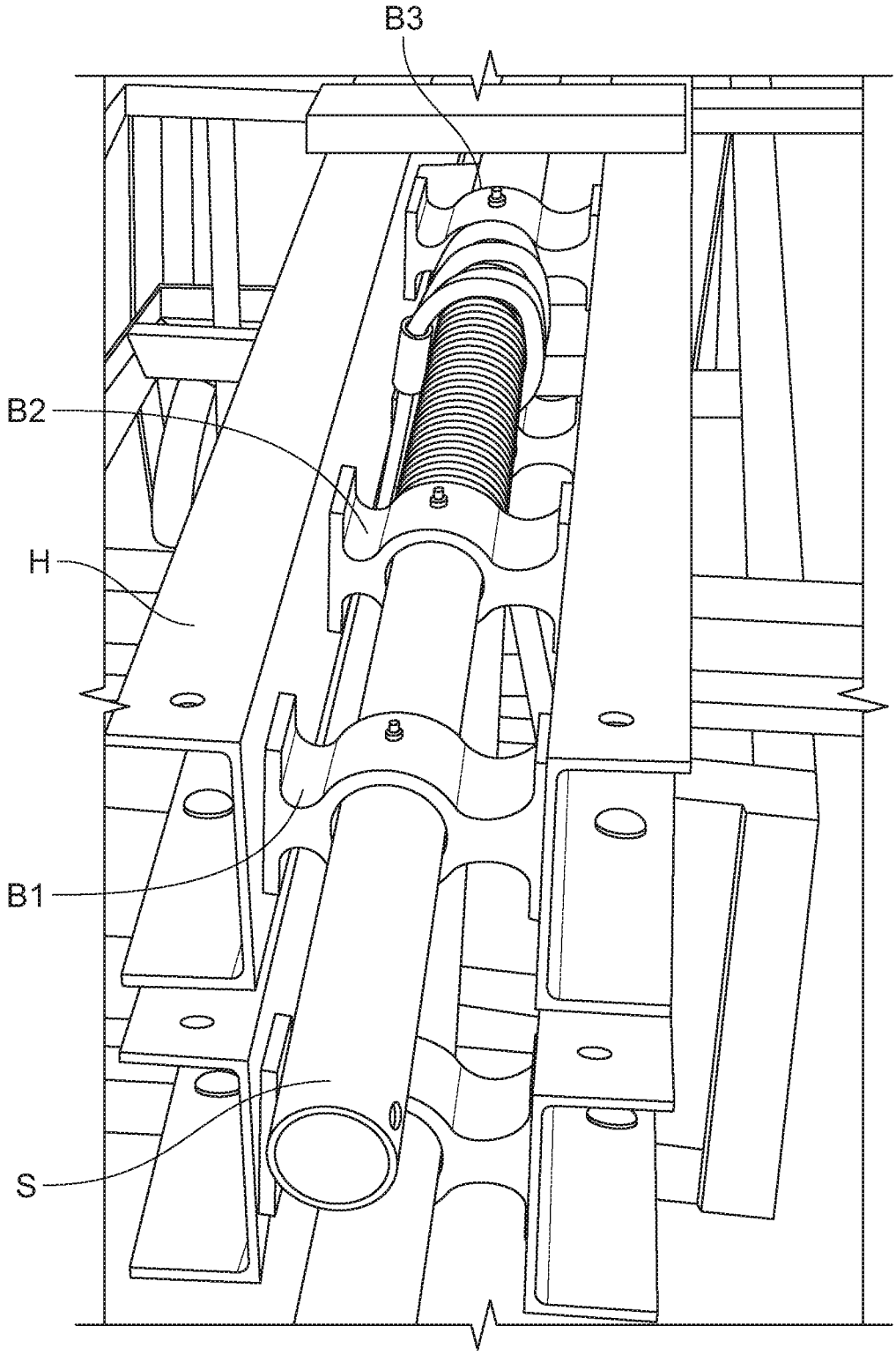
FIG. 1 (Prior Art)
FIG. 1 depicts a prior art boat lift apparatus.

FIG. 1 depicts a prior art boat lift apparatus. Referring to FIG. 1, the bearing blocks B1, B2, B3 are welded to a housing H such that a shaft S and any other components along the shaft S must be slid through the opening of each bearing block B1, B2, B3, for as long as the lift mechanism extends. In the event of a single bearing block B1, B2, B3 failing or wearing out, the entire lift mechanism must be replaced, which can be a costly, time consuming, and dangerous procedure, as such lift mechanisms are often positioned on stationary piles in bodies of water.

Boat lift assemblies of the present disclosure are configured to alleviate at least one or more of the foregoing drawbacks of typical boat lift assemblies and, thereby, provide one or more advantages over typical boat lift assemblies.

In certain aspects, the present disclosure relates to systems and methods related to lift mechanism of boat lifts and systems for adjustable boat lifts. An example embodiment according to the present disclosure provides a boat lift apparatus comprising a support beam including a motor connected to a gearbox, one or more load-bearing blocks spaced along a length of the support beam and comprising a first part rigidly fastened to the support beam and a second part movably fastened to the first part of a respective load-bearing block, and a cable winding shaft comprising one or more cable spools, the cable winding shaft positioned over the first part of the one or more load-bearing blocks (also referred to herein, simply, as "bearing blocks") and extending from the gearbox. The one or more load-bearing blocks can be configured to fit the output shaft and one or more cable winders within the first part.

Another example embodiment of the present disclosure provides an adjustable boat lift apparatus comprising frame towers and a frame base. Each frame tower can include a foot at a first end and connect to a support beam on a second end. The support beam can be connected to at least two frame towers. The frame base can be positioned between four or more frame towers and define a horizontal plane. The frame base can be movable along a vertical axis between the feet of the frame towers to the support beam.

An example embodiment of the present disclosure provides a method of manufacturing a boat lift apparatus. The method can include providing a support beam; fastening, to the support beam, a first part of a bearing block comprising a U-shaped internal surface configured to fit a cable winding shaft; positioning the cable winding shaft within the first part of the load-bearing block; and fastening a second part of the load-bearing block to the first part and over the cable winding shaft.

An example embodiment of the present disclosure provides a boat lift assembly with a support beam, a cable winding shaft, and one or more load-bearing blocks. The load-bearing blocks (also referred to herein as bearing blocks) can include a first part and a second part. The first part of each load-bearing block can be fastened to the support beam via bolts, screws, pins and/or rivets (e.g., sized between about 2 inches to 4½ inches). Fastening devices as described herein can allow for the first part of the bearing block to be removable or adjusted along the support beam, while also maintaining the strength of a bearing block that is welded, soldered, or adhesively bonded to the support beam.

The second part of the load-bearing block can be fastened to the first part by two or more bolts, or by screws, pins and rivets, and the like (e.g., the second part can be connected to first part with bolts or screws sized between ⅜th inches or ½ inch). Alternatively, or in addition thereto, second part of the load-bearing block can be fastened to the first part by a more permanent processes, such as welding, adhesive bonding, or soldering, after the cable winding shaft and other lift components are positioned within the first part of the bearing block.

The load-bearing blocks can be spaced along a length of the support beam. Any number of load-bearing blocks can be used to allow for additional support for boats having more weight. In addition, load-bearing blocks can be added or removed along the support beam to accommodate a change in boat weight or add strength along the length of the cable winding shaft.

Load-bearing blocks can be made of galvanized steel, stainless steel, marine-grade aluminum, metal alloys (e.g., 6061T6, 6005T5), polymers (e.g., nylatron nylon, fiber Kevlar, Nomex, etc.), and the like. In addition, load-bearing blocks can be coated with an acrylic or non-acrylic polymeric coating to protect against marine conditions including salt water, biofilms, rust, and rain. The load-bearing blocks can be made of various thicknesses ranging from approximately 10 millimeters to approximately 1000 millimeters, preferably 30 millimeters to 130 millimeters, (1½ inches to 5 inches wide), and more preferably approximately 50 mm wide (2 inches). In addition, load-bearing blocks can be of a certain thickness along the portion in contact with the support beam, while having an increased thickness at the bottom portion contacting the cable winding shaft.

The first part of the load-bearing block can having a grease valley on an internal surface of the first part. The grease valley can be positioned on the internal surface of the first part and creates a void in the area experiencing the greatest weight of the cable winding shaft. When additional grease is added to the cable winding shaft, the void created by the grease valley allows for proper lubrication along the entire cable winding shaft. The grease valley can be any suitable shape that is, e.g., etched into the internal surface of the first part of the bear block, such as, for example, an "X" shape. Additional shapes include an oval, a line, a rectangle, a star, and the like.

One or more cable spools can be mounted to the cable winding shaft, for winding lift cables around the spools The cable winding shaft can be in communication with a gearbox such that the control of the gearbox from a motor can cause the cable winding shaft to rotate and either wind or unwind the cables onto or off of the spool(s) to lift or lower a cradle and thereby lift or lower a boat within the lift apparatus, respectively.

Adding an additional first part of a load-bearing block to the boat lift apparatus can be performed by positioning the inner surface of the first part of the load-bearing block around the cable winding shaft. This can be done to add additional load-bearing blocks to the boat lift apparatus or to replace a load-bearing block in the event of a failure of another load-bearing block. The newly added first part can be secured to each side of the support beam by any method described herein.

Support beams of the boat lift can be positioned horizontally over two frame towers (also referred to herein as vertical members of a frame). Additional frame towers (e.g., 3 or 4 or 5 towers) can be used to hold a single support beam to add support or length to support beam.

An embodiment of a boat lift according to the present disclosure includes a support beam connected to two frame towers. The cradle can be in a lower position near the feet of the frame towers when ready to receive a boat. When a user is ready to lift the boat out of the water, the support beam and lifting mechanism within can rotate and wind the cables such that the frame base moves vertically to a second position near the support beam.

In examples, the opposing frame towers may be moved closer together or further apart such that the width of the frame, as well as the width of the cable can be adjusted to the size of the boat to be lifted and lowered. Adjusting the width may be done with any suitable linear-motion telescopic mechanism or a manual adjustment via multiple keyholes and pins for extending the frame. Similarly, the frame towers may be adjustable in height such that the boat lift may be adjusted for depth of water as well as size of boat.

The support beam can include a motor connected to a gearbox that powers the cable winding shaft and causes the boat lift apparatus to lift and lower the cradle. The motor(s) can be any suitable AC or DC motor or any suitable power, (e.g., 24-volt) system. The lift cable can extend from the support beam to the cradle. When the adjustable boat lift is in the lowered position with the cradle near the feet of the frame tower, a portion of the cables can be in contact with water, but the lift mechanism remains out of the water.

In some embodiments, the cradle includes supports that can slide apart to increase a width of the boat cradle. The cradle supports can be slid to the proper position manually or can be connected to a hydraulic system such that the movement of sliding the boat cradle can be done electronically.

In some embodiments, an adjustable boat lift according to the present disclosure can be configured to lift and lower a boat weight up to 20,000 lbs (e.g., up to 19,000 lbs, up to 18,000 lbs, up to 17,000 lbs, up to 16,000 lbs, up to 15,000 lbs, up to 14,000 lbs, up to 13,000 lbs, up to 12,000 lbs, up to 11,000 lbs, up to 10,000 lbs, up to 9,000 lbs, up to 8,000 lbs, up to 7,000 lbs, up to 6,000 lbs, up to 5,000 lbs, up to 4,000 lbs, up to 3,000 lbs, and any value in between, e.g., about 12,542 lbs or 7,498 lbs).

An example method of assembling a boat lift according to the present disclosure can include providing a support beam and fastening a first part of a load-bearing block to the support beam. The first part of the load-bearing block can include a U-shaped internal surface configured to fit an output shaft. The example method can further include positioning the cable winding shaft within the first part of the load-bearing block. The cable winding shaft can be fully prepared and include the cable spools all cables and all other components necessary for functioning as a lift mechanism. Next, the method can include fastening a second part of the load-bearing block to the first part and over the output shaft.

The method can also include forming a grease valley on the U-shaped internal surface of the load-bearing block. In addition, the method can include adding an additional load-bearing block or removing a load-bearing block without the need to disassemble the entire lifting apparatus. In particular, to add an additional load-bearing block, the method can include sliding the first part of the additional load-bearing block around the cable winding shaft, fastening the first part of the additional load-bearing block to the support beam; and fastening the second part of the additional load-bearing block to the first part and over the output shaft.

To remove a load-bearing block, the method can include removing the second part of the load-bearing block; unfastening the first part of the load-bearing block; and sliding the first part of the load-bearing block away from the output shaft.

To facilitate an understanding of the principles and features of the present disclosure, various illustrative embodiments are explained below. The components, steps, and materials described hereinafter as making up various elements of the embodiments disclosed herein are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

The following examples further illustrate aspects of the present disclosure, including aspects just described. However, they are in no way a limitation of the teachings or disclosure of the present disclosure as set forth herein.

Figure 2:
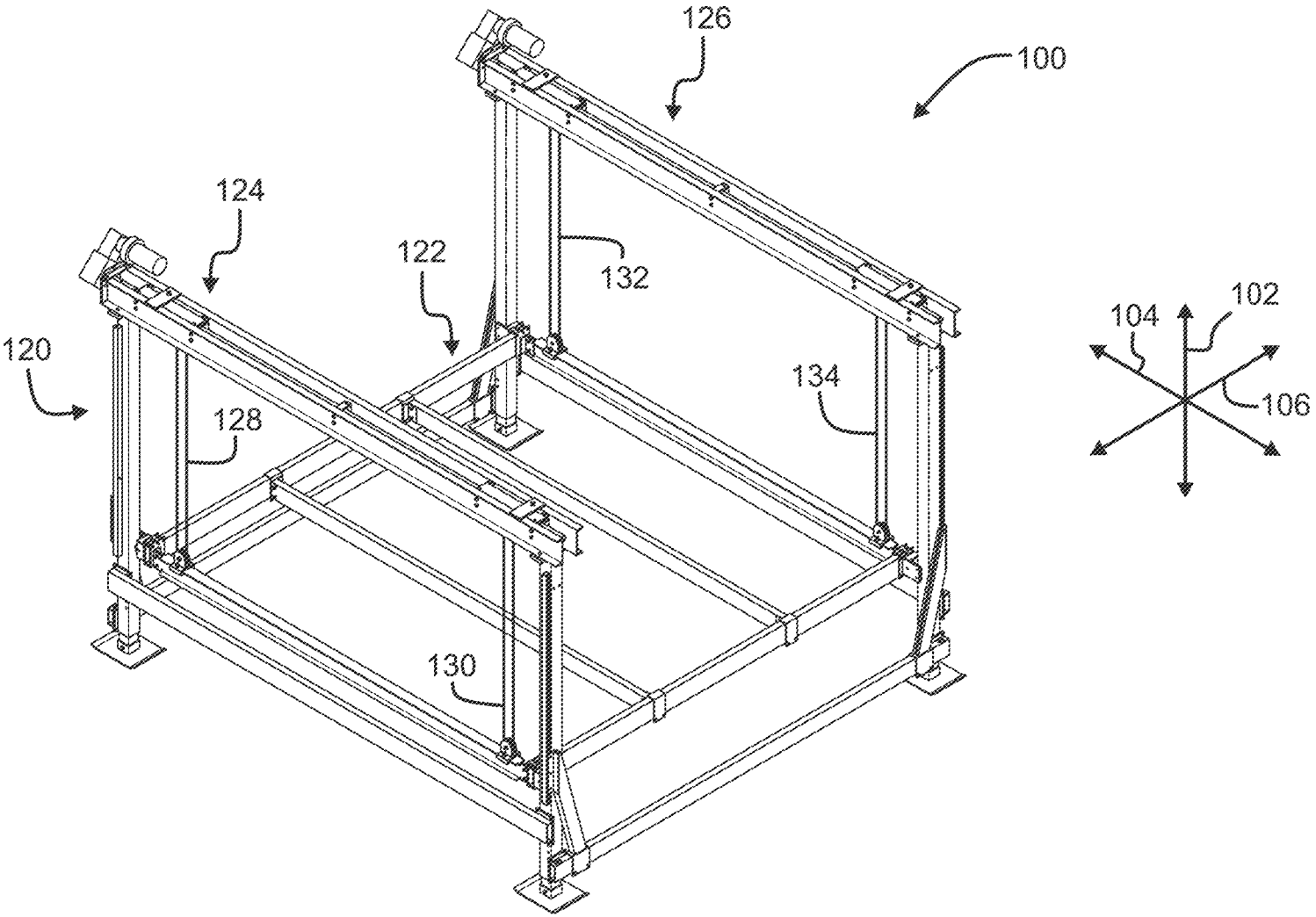
FIG. 2 is a perspective view of an example boat lift assembly according to the present disclosure.
Figure 3:
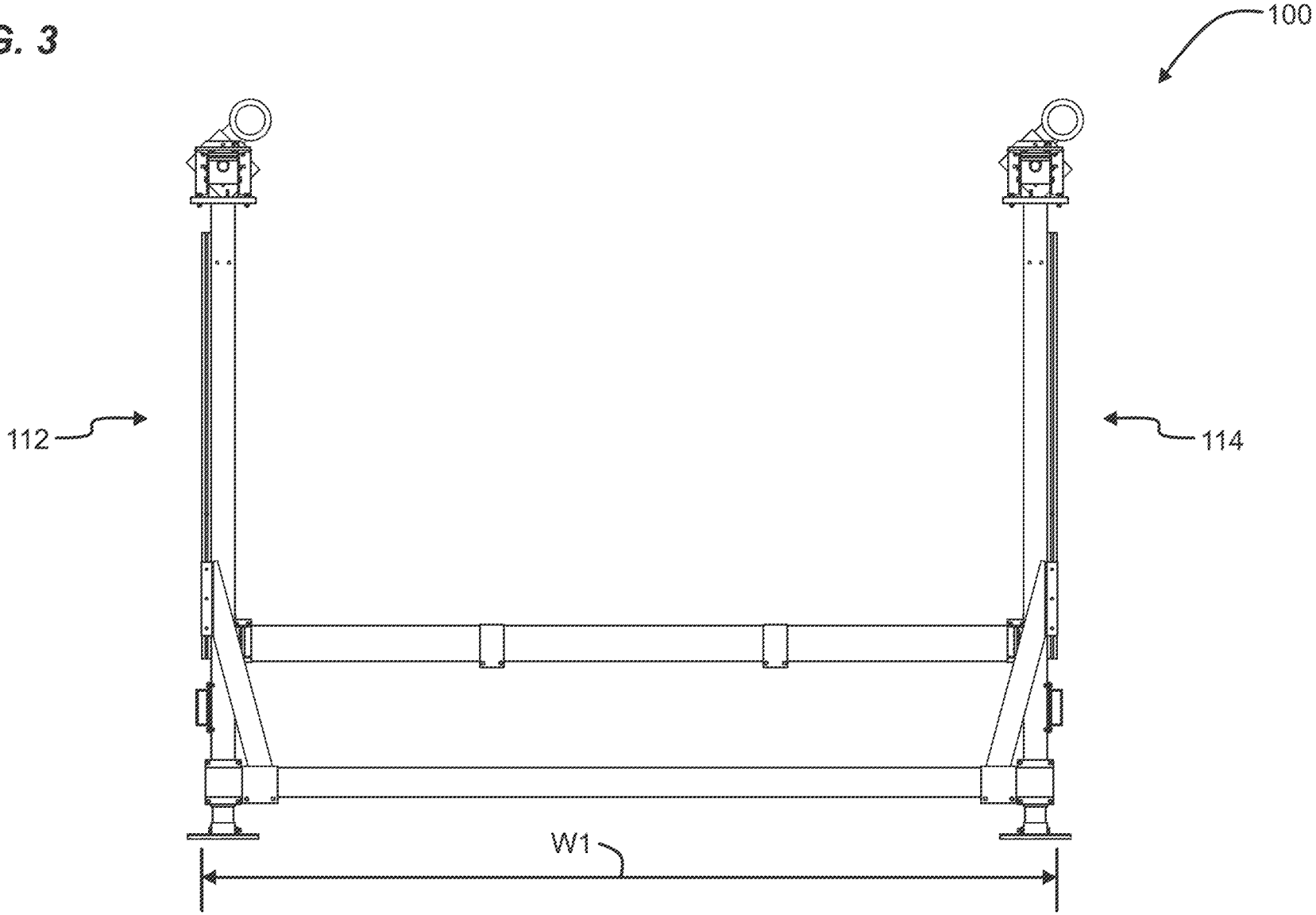
FIG. 3 is an end view of the boat lift assembly of FIG. 2.
Figure 4:
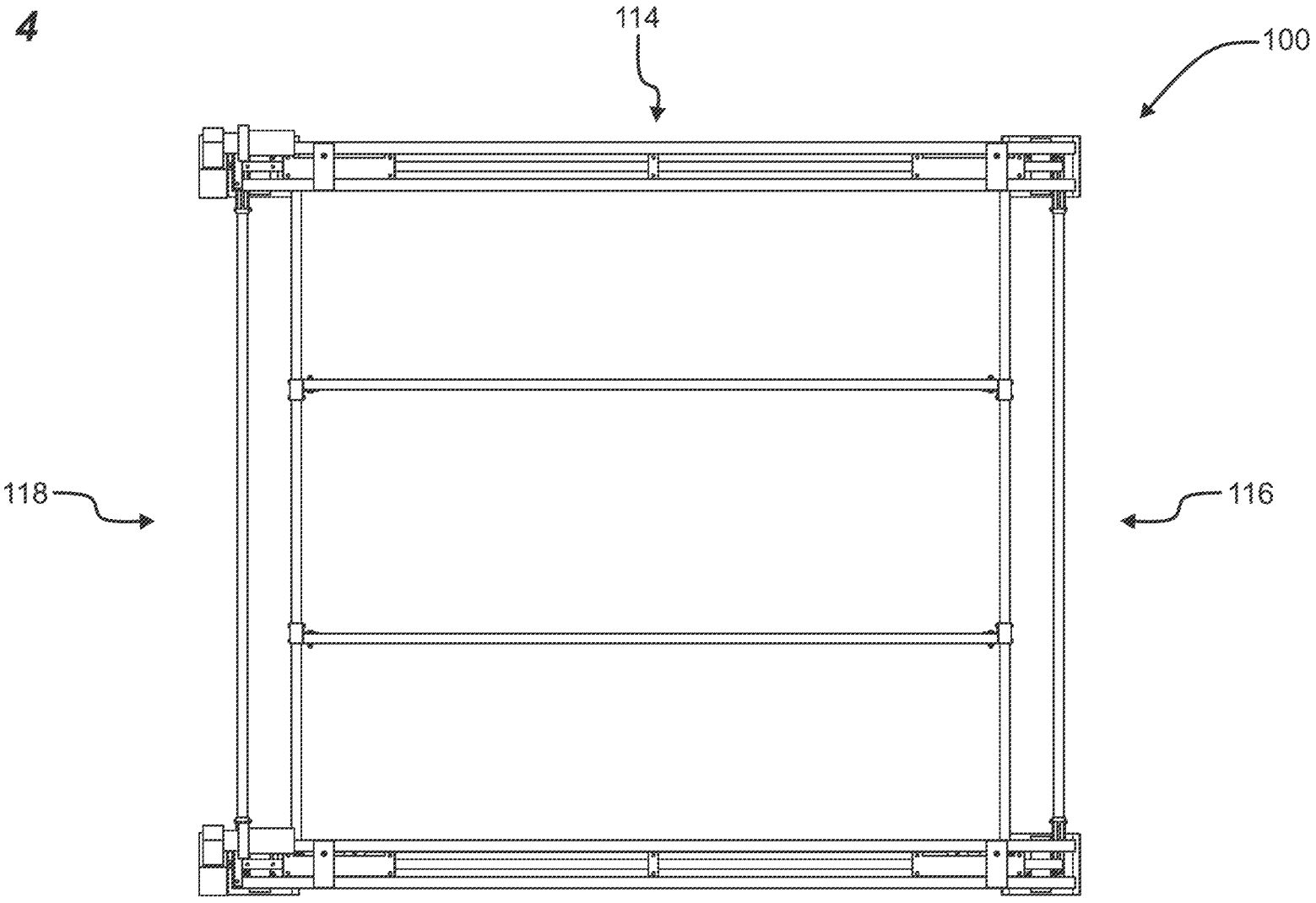
FIG. 4 is a top view of the boat lift assembly of FIG. 2.
Figure 5:
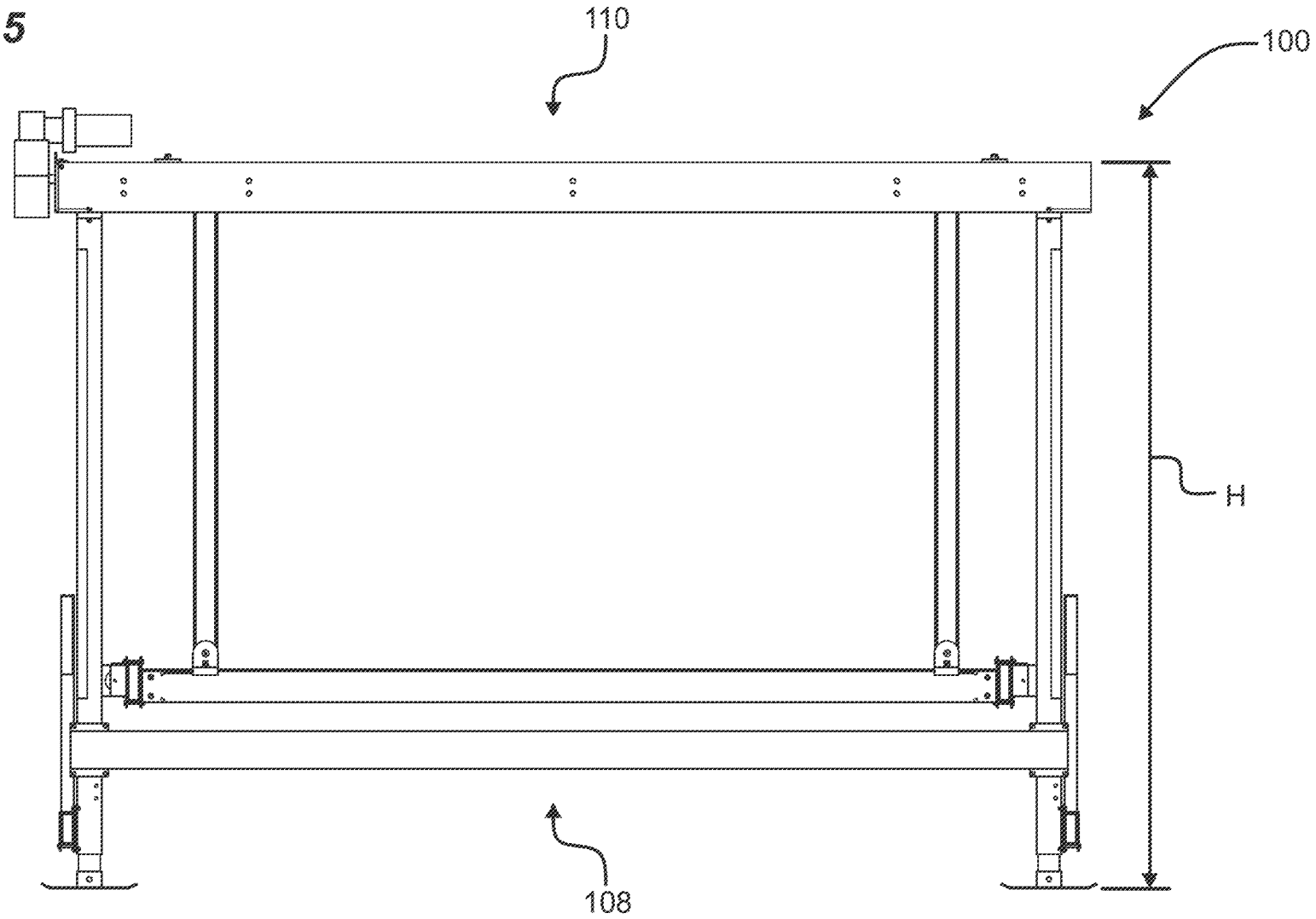
FIG. 5 is a side view of the boat lift assembly of FIG. 2.
Figure 6:
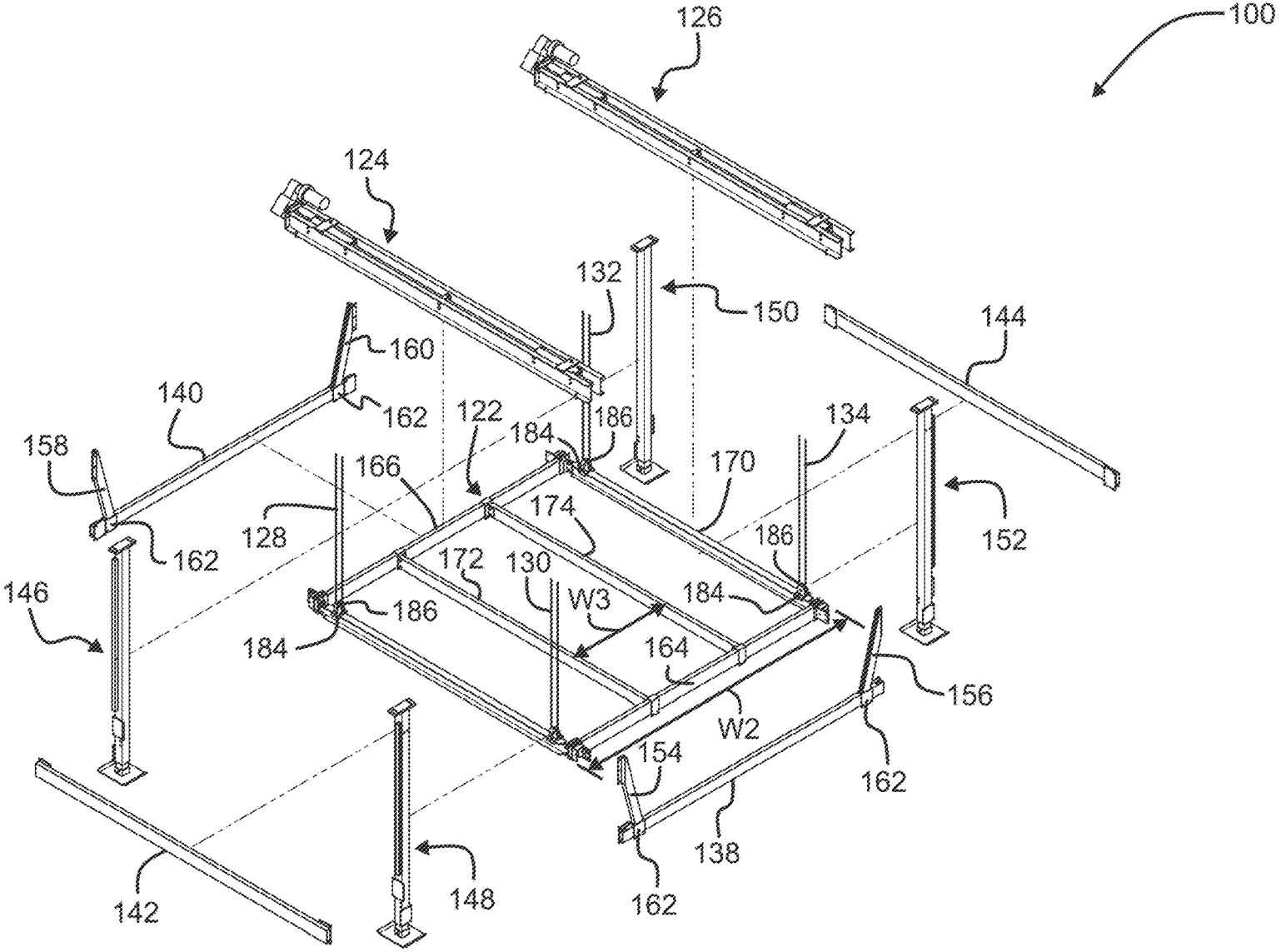
FIG. 6 is a partially exploded view of the boat lift assembly of FIG. 2.

FIG. 2 is a perspective view of an example boat lift assembly 100 according to the present disclosure. FIG. 3 is an end view of the boat lift assembly 100 of FIG. 2. FIG. 4 is a top view of the boat lift assembly 100 of FIG. 2. FIG. 5 is a side view of the boat lift assembly 100 of FIG. 2. FIG. 6 is a partially exploded view of the boat lift assembly 100 of FIG. 2.

Referring to FIGS. 2-6, the boat lift assembly 100 extends from a bottom 108 of the assembly to a top 110 of the assembly parallel to a vertical axis 102. The assembly 100 extends from a left side 112 to a right side 114 parallel to a first horizontal axis 106. The assembly 100 extends from a front end 116 to a back end 118 along a second horizontal axis 104. The horizontal axes 104 and 106 are perpendicular to each other and define a horizontal plane. The horizontal axes 104 and 106 are perpendicular to the vertical axis 102. The pair of axes 102 and 104, and the pair of axes 102 and 106 define vertical planes, respectively, that are perpendicular to each other.

As used herein, terms such as vertical, horizontal, above, below, bottom, top, front, back, left, right, and so forth are used as a descriptive aid in describing relative positions of different components of assemblies to one another in certain embodiments. These terms should not be construed as limiting how these assemblies may be oriented or positioned in different use applications.

The assembly 100 includes a frame 120, a cradle 122, a lift subassembly 124 and a lift subassembly 126.

The frame 120 is free-standing and is configured to be placed directly on the bottom of the body of water (e.g., a lake bed, a river bed, a sea floor, and so forth). That is, the frame 120 does not need to be fastened to piles that are embedded in the bottom of the body of water. Because the frame 120 is free-standing, this allows the frame 120 to be easily moved out of the water (e.g., before the body of water freezes over for winter), disassembled, and installed at another location or in the same location at a later time.

The lift subassemblies 124 and 126 are mounted to the frame 120 at upper ends of vertical member subassemblies of the frame 120.

The cradle 122 is coupled to the lift subassemblies 124, 126 by cables 128, 130, 132, 134. In other examples, more or fewer cables can be used to couple the cradle to the lift subassemblies.

Figure 25:
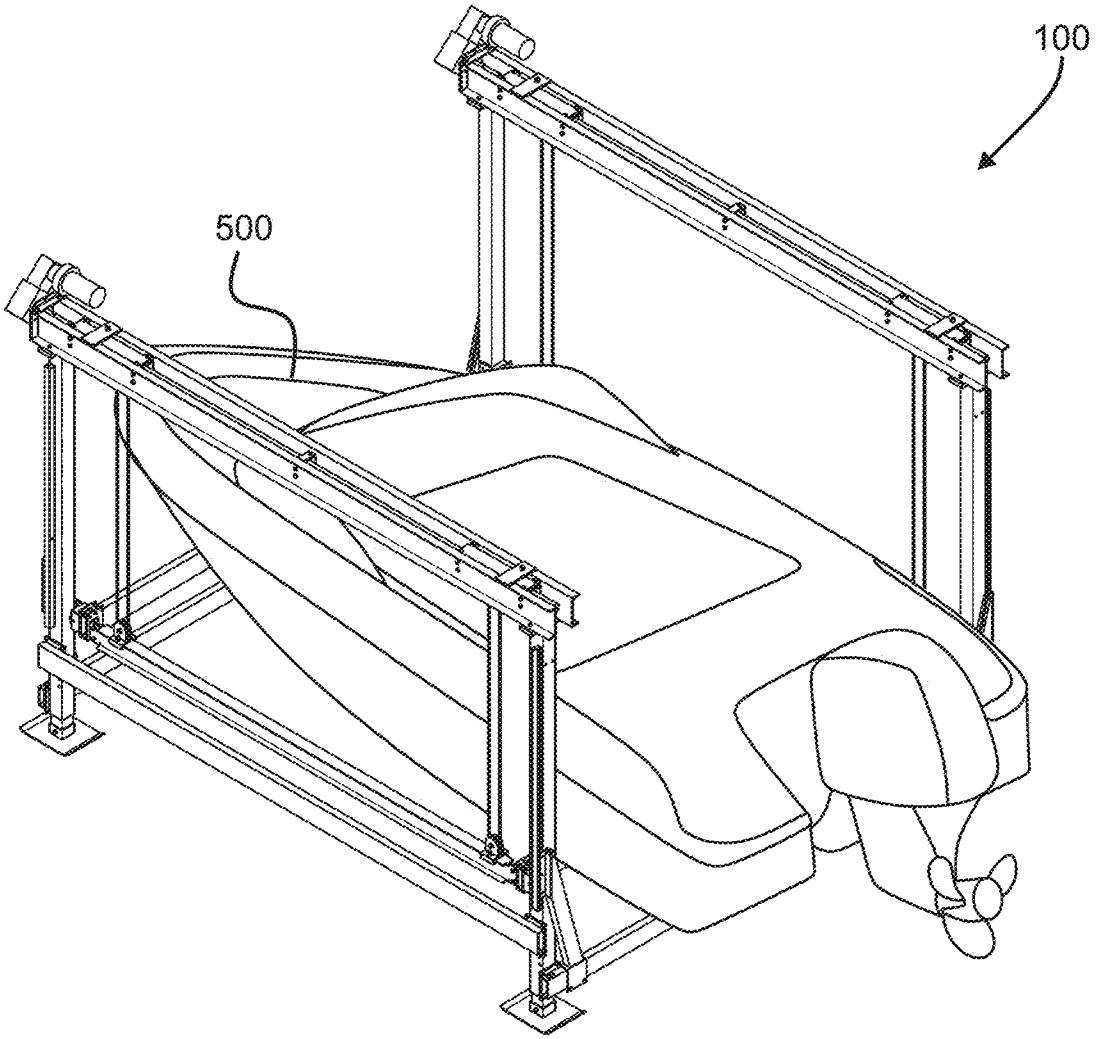
FIG. 25 is a perspective view of the boat lift of FIG. 2 supporting a boat.

The cradle 122 is configured to support a watercraft, such as a boat 500 (FIG. 25). Via the lift subassemblies 124 and 126, a watercraft positioned on the cradle 122 can be lowered into the body of water, e.g., to operate the watercraft on the body of water, or lifted out of the body of water, e.g., to transport the watercraft to a location on land for, e.g., maintenance, repairs, storage, and the like.

A watercraft buoyantly supported by a body of water can enter the front end or the back end of the assembly 100 positioned in the body of water either bow first or stern first until the hull of the boat engages the cradle 122.

The assembly 100 is configured such that when the cradle 122 is in a position such that a watercraft supported by the cradle 122 is fully above the surface of the body of water, no portion of the lift subassemblies 124, 126 or the cables 128, 130, 132, 134 are submerged in the body of water. In addition, the assembly 100 is configured such that when the cradle 122 is in a position such that a watercraft supported by the cradle 122 is buoyantly supported by the body of water and the cradle is submerged in the body of water, only lower portions of the cables and the pulleys that couple the cables to the cradle 122 are submerged in the body of water.

The frame 120 includes a number of elongate horizontal members and elongate vertical members that are fastened to one another and, in some cases, as frame member subassemblies, to form the frame 120. As used herein, an elongate horizontal member has an elongate dimension that is at least substantially parallel to one of the horizontal axes 104, 106 when the assembly 100 is assembled. As used herein, an elongate vertical member has an elongate dimension that is at least substantially parallel to the vertical axis 102 when the assembly 100 is assembled.

In some examples, the frame 120 is constructed of one or more strong, durable materials that is/are resistant to corrosion, such as aluminum or steel. Components can be made of galvanized steel, stainless steel, marine-grade aluminum, metal alloys (e.g., 6061T6, 6005T5), polymers (e.g., nylatron nylon, fiber Kevlar, Nomex, etc.), and the like. In addition, components can be coated with an acrylic or non-acrylic polymeric coating to protect against marine conditions including salt water, biofilms, rust, and rain.

Components of the frame 120 can be fastened together with suitable fasteners, such as screws and/or bolts. In at least some examples, the fasteners are configured to be easily removed and reinstalled to allow for disassembly of frame 120, adjusting of the frame 120 to different dimensions, and reassembly of the frame 120. In some examples, brackets or similar fittings can be positioned at connection locations between different members of the frame. Such brackets can include member receivers (e.g., U-shaped and/or L-shaped receivers) for receiving two different frame members. Fasteners can then be inserted into the brackets and the frame members to secure each frame member directly to the corresponding receiver.

The frame 120 includes four horizontal members and four vertical member subassemblies. The horizontal members include a front horizontal member 138 a back horizontal member 140, a left side horizontal member 142, and a right side horizontal member 144. The horizontal members 138 and 140 are elongate parallel to the horizontal axis 106. The horizontal members 142 and 144 are elongate parallel to the horizontal axis 104. The vertical member subassemblies 146, 148, 150 and 152 (also referred to herein as towers) are each elongate parallel to the vertical axis 102.

The horizontal member 142 is fastened, e.g., with removable fasteners and brackets, to the vertical member subassemblies 146 and 148 at opposite ends of the horizontal member 142 and near the bottoms of the subassemblies 146 and 148. The horizontal member 144 is fastened, e.g., with removable fasteners and brackets, to the vertical subassemblies 150 and 152 at opposite ends of the horizontal member 142 and near the bottoms of the vertical subassemblies 150 and 152.

The frame 120 includes coupling members 154, 156, 158 and 160 (also referred to herein as width adjustment members). The coupling members 154, 156, 158 and 160 allow a width W1 of the frame 120 parallel to the axis 106 to be adjusted to different width dimensions. For example, one of the brackets 162 of one of the coupling members 154, 156 can be slid along the horizontal member 138 towards to the other coupling member 156, 154 and refastened to the horizontal member 138, and a corresponding one of the brackets 162 of the coupling members 158, 160 can be slid along the horizontal member 140 towards the other coupling member 160, 158 and refastened to the horizontal member to reduce the width W1. Similarly, both sets of coupling members 154, 156 and 158, 160 can be slid towards each other to reduce to the width W1. Sliding the couplers away from each other can increase the width W1. In some examples, the width W1 can be adjusted in a range from about 96 inches to about 144 inches. In other examples, the width W1 can be adjusted to values outside of this range. Alternative mechanisms, as described above, for adjusting the width W1 can be used.

Figure 9:
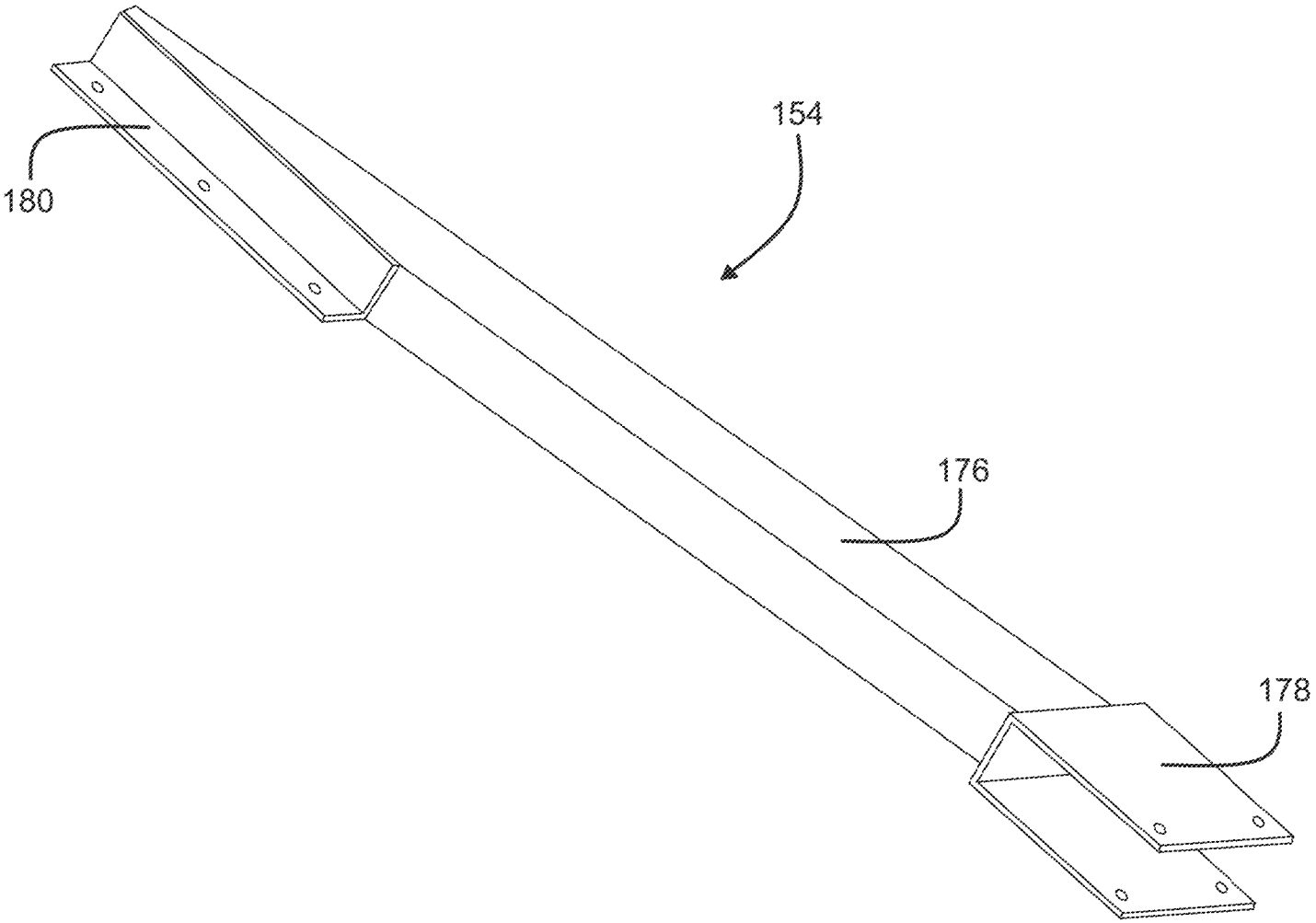
FIG. 9 is a perspective view of a width adjusting member of the frame of the assembly of FIG. 2.
Figure 10:
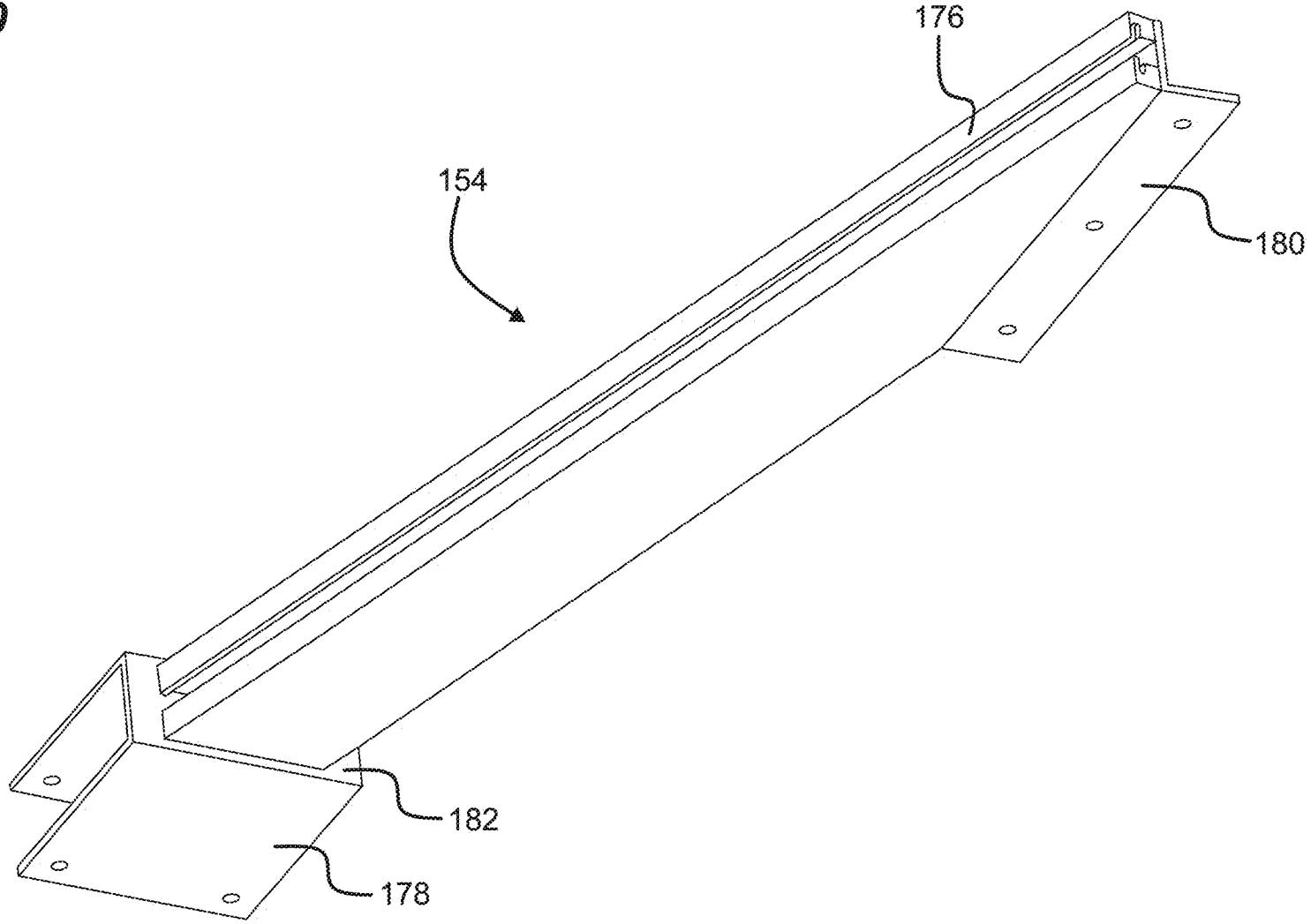
FIG. 10 is a further perspective view of the width adjusting member of FIG. 9.
Figure 11:
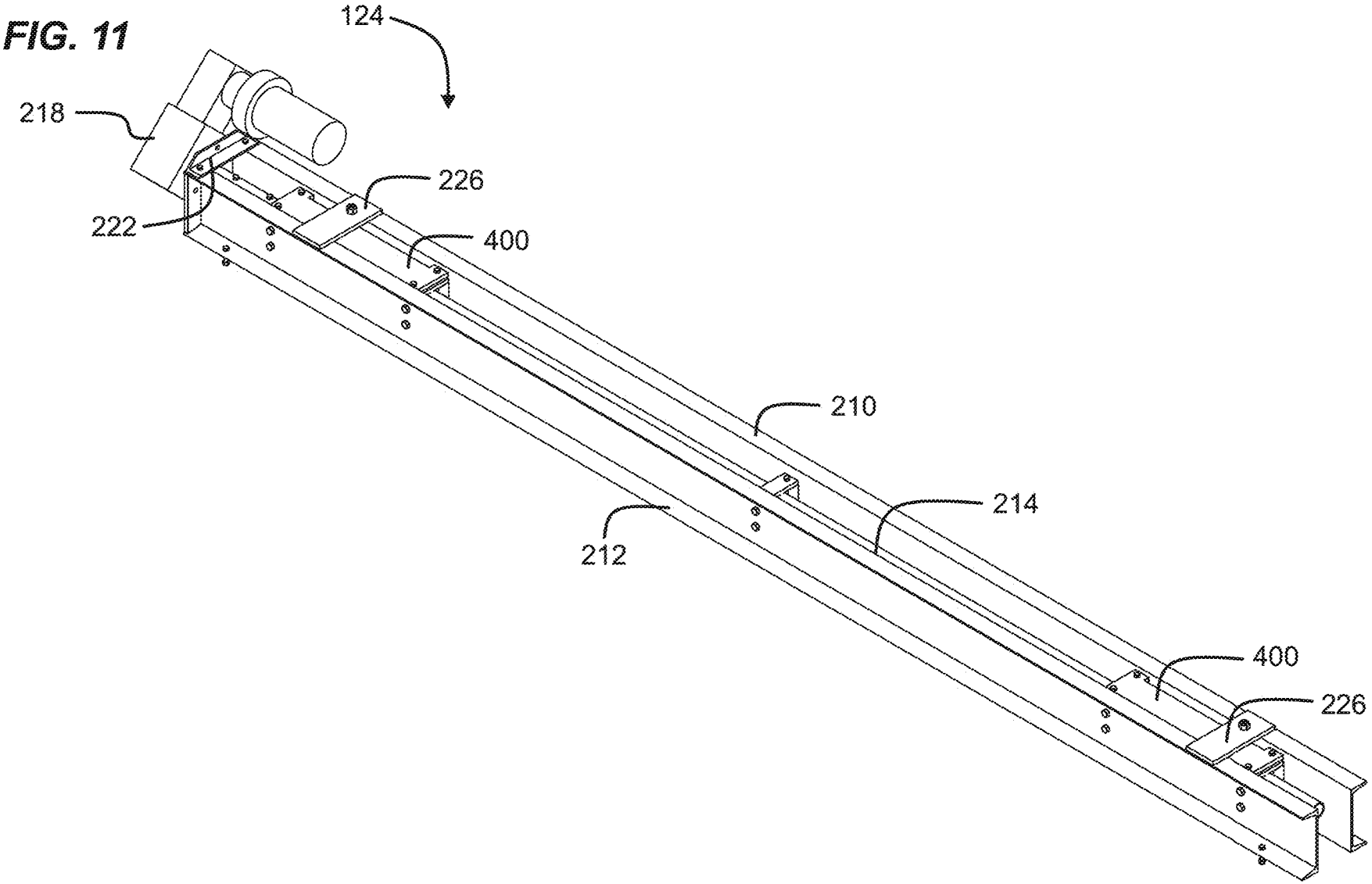
FIG. 11 is a perspective view of a lift subassembly of the assembly of FIG. 2.

Referring to FIGS. 9-10, an example of one of the coupling members 154 is shown. The coupling member 154 includes a body 176, a U-shaped bracket 178 and an L-shaped bracket 180. The bracket 178 is configured to receive and adjustably mount to different positions on a horizontal member 138, 140, e.g., with one or more fasteners. The bracket 180 is configured to receive and mount to a vertical member subassembly 148, 150, e.g., with one or more fasteners. The body 176 extends from a surface 182 of the bracket 178 at an oblique angle to the surface 182, extending to the bracket 180. This oblique angle can provide a clearance such that the coupling member does not interfere with other frame members or other connections between frame members where, for example, the frame members 138, 142 and 148 come together.

The ability to adjust the width W1 of the frame 120 can allow for the assembly 100 to be adjusted to, e.g., different boat launch area dimensions (e.g., in a narrow space between docks), In addition, the ability to adjust the width DI of the frame 120 can allow the assembly 100 to be stored assembled but in a more compact state. In addition, the ability to adjust the width DI of the frame 120 can allow the assembly to accommodate a greater variety of watercraft shapes and/or sizes.

In some examples, a height H parallel to the vertical axis 102 of the frame 120 is also adjustable. Adjusting the height H can allow the assembly 100 to accommodate different water depths, for example.

In some examples, the height parallel to the vertical axis 102 of each vertical member subassembly 146, 148, 150, 152 can be individually adjusted to be different heights or the same heights as one another. Individually adjusting the heights of the vertical member subassemblies can allow the assembly 100 to, e.g., accommodate an uneven bed or floor of the body of water (e.g., one of the vertical member subassemblies is adjusted to have a different length than another), while maintaining the horizontal members of the frame elongate perpendicular to the force of gravity.

Figure 7:
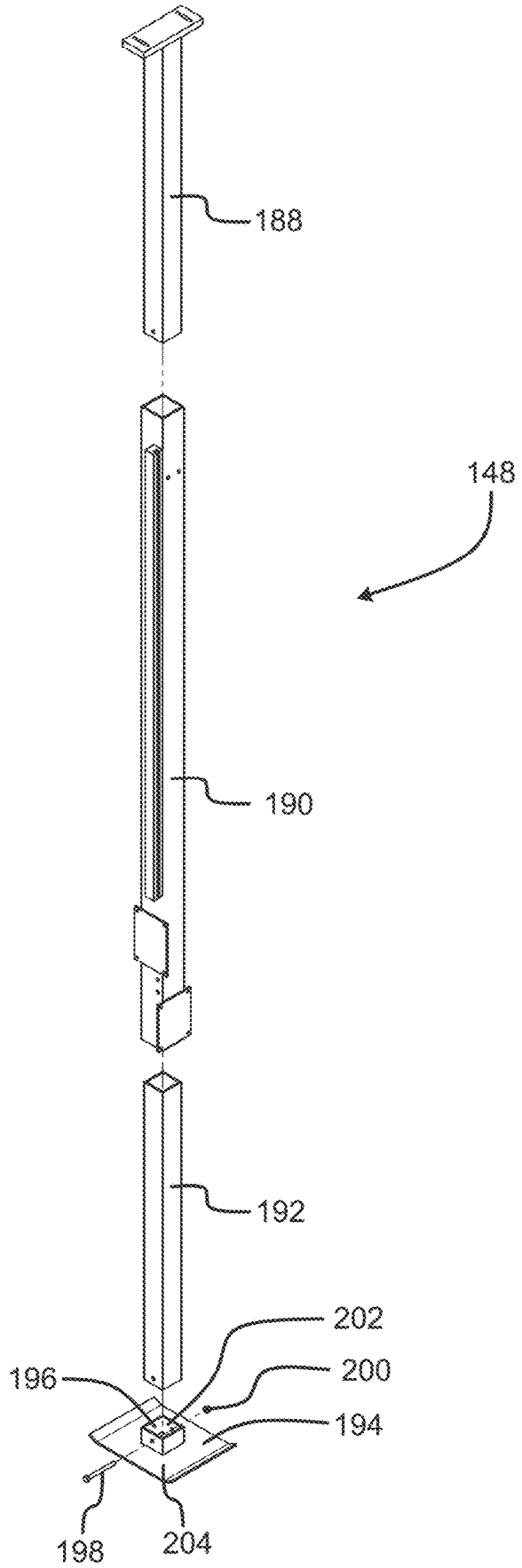
FIG. 7 is an exploded view of a vertical member subassembly of the boat lift assembly of FIG. 2.
Figure 8:
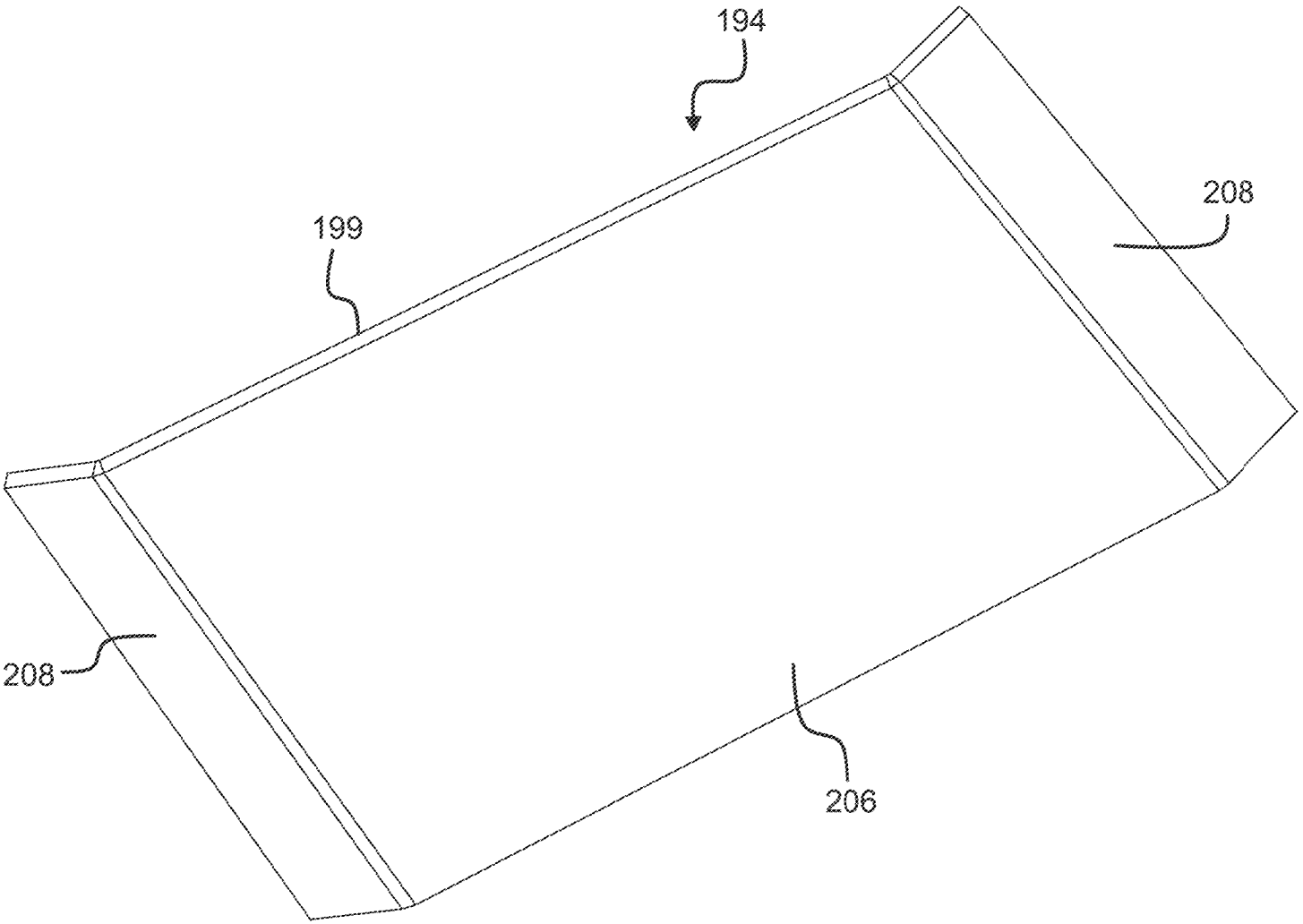
FIG. 8 is a perspective view of the foot of the vertical member subassembly of FIG. 7.

Referring to FIGS. 7-8, components of one of the vertical member subassemblies 148 of the assembly 100 are shown. The other vertical member subassemblies can have the same components as subassembly 148 though, in some examples, two of them can have the components oriented to be a mirror image to those of the subassembly 148.

The subassembly 148 includes an upper member 188, a middle member 190, a lower member 192, and a foot 194. A lower portion of the upper member 188 fastens to an upper portion of the middle member 190. An upper portion of the lower member 192 fastens to a lower portion of the middle member 190. The foot 194 includes a receiver 196 that receives a lower portion of the lower member 192. The foot 194 can thereby be fastened to the lower member 192, e.g., with a bolt 198 and a nut 200.

To adjust the height H of the subassembly 148, the fastening location of the upper member 188 to the middle member 190 and/or the fastening location of the lower member 192 to the middle member 190 can be adjusted by sliding the components relative to each other to a desired height and then fastening them together.

The foot 194 includes a foot body 199 and the receiver 196 defining a recess 202. The receiver 196 projects upward from an upward facing surface 204 of the foot body 199. The foot body 199 includes a downward facing surface 206 opposing the surface 204. The surface 206 is configured to rest on the bottom of the body of water. Extending from opposite sides of the surfaces 204 and 206 are flanges 208. The flanges 208 extend from surfaces 204 and 206 at oblique angles to the surfaces 204 and 206. The flanges 208 can, e.g., improve water flow around the assembly 100 as it is being lowered into the water. The flange 208 can, e.g., increase the stability of the assembly 100, e.g., if the assembly 100 starts to rock due to water currents.

Referring again to FIGS. 1-6, the cradle 122 includes a number of elongate horizontal members that are fastened to one another and to form the cradle 122.

In some examples, the cradle 122 is constructed of one or more strong, durable materials that is/are resistant to corrosion, such as aluminum or steel. Components of the cradle can be made of galvanized steel, stainless steel, marine-grade aluminum, metal alloys (e.g., 6061T6, 6005T5), polymers (e.g., nylatron nylon, fiber Kevlar, Nomex, etc.), and the like. In addition, components of the cradle can be coated with an acrylic or non-acrylic polymeric coating to protect against marine conditions including salt water, biofilms, rust, and rain.

Components of the cradle 122 can be fastened together with suitable fasteners, such as screws and/or bolts. In at least some examples, the fasteners are configured to be easily removed and reinstalled to allow for disassembly of cradle, adjusting of the cradle 122 to different dimensions, and reassembly of the cradle 122. In some examples, brackets or similar fittings can be positioned at connection locations between different members of the cradle. Such brackets can include member receivers (e.g., U-shaped and/or L-shaped receivers) for receiving two different cradle members. Fasteners can then be inserted into the brackets and the cradle members to secure each cradle member directly to the corresponding receiver.

The cradle 122 includes six horizontal members. The horizontal members include a front horizontal member 164, a back horizontal member 166, a left side horizontal member 168, and a right side horizontal member 170. The horizontal members 164 and 166 are elongate parallel to the horizontal axis 106. The horizontal members 168 and 170 are elongate parallel to the horizontal axis 104.

The cradle 122 also includes two hull support members 172 and 174 that are elongate parallel to the axis 104.

The horizontal members 168 and 170 and the hull support members 172 and 174 are fastened, e.g., with removable fasteners and brackets, at either end to the horizontal members 164 and 166, respectively. A width W2 of the overall cradle 122 can be adjusted by repositioning one or more of the horizontal members 168 and 170 closer to the/each other on the horizontal members 164 and 166. A width W3 of the hull support area of the cradle 122 can be adjusted by repositioning one or more of the horizontal members 172 and 174 closer to the/each other on the horizontal members 164 and 166.

The ability to adjust the width W2 can allow for the width dimension of the cradle 122 to substantially match the corresponding width dimension W1 of the frame 120, even when the width W1 is adjusted. The ability to adjust the width W3 can allow the assembly to accommodate a greater variety of watercraft shapes and/or sizes.

In some examples, bumpers and/or guides (not shown) can be mounted to the cradle 122 to help guide a watercraft onto the hull support member 172 and 174 and to center the watercraft on the hull support members 172, 174. This can prevent the watercraft from contacting the frame 120 while entering the cradle 122, which could cause damage to the watercraft and/or to the frame 120.

Fittings 184 are connected (e.g., by fasteners, soldering, welding, rivets, or other fastening means) to the horizontal members 168 and 170 of the cradle 122. In this example, two fittings 184 are connected to each horizontal member 168 and 170. In other examples, more or fewer such fittings can be provided for the cradle 122. Integrated with, or otherwise attached to each fitting 184 is a pulley 186. The bottom portions of the cables 128, 130, 132 and 134 are installed in the wheels of the pulleys 186 and upper portions of the cables 128, 130, 132 and 134 are wound around spools of the lift subassemblies 124 and 126. As the spools rotate to wind or unwind the cables, depending on the direction of rotation, the length of the cables between the pulleys 186 either increases or decreases, causing the cradle to lower relative to the frame 120 or to raise relative to the frame 120. Thus, for example, to lower a boat supported by the cradle into a body of water, the spools are rotated to unwind the cables 128, 130, 132 and 134 from the spools, whereas to raise a boat supported by the cradle 122 from the body of water, the spools are rotated to wind up the cables 128, 130, 132 and 134 on the spools.

The cables can be constructed of any suitable strong, durable, and corrosion resistant materials, such as coated woven metal cables.

In some examples, the lift subassemblies 124 and 126 can have the same components as each other. In other examples, the lift subassemblies 124 and 126 can include different components from one another. For instance, the overall boat lift assembly can include a single motor, instead of two or more motors that drive rotation of the cable winding shafts of both lift subassemblies 124 and 126.

Referring to FIGS. 11-14, one of the lift subassemblies 124 will now be described.

The lift subassembly 124 includes two horizontally elongate beams 210 and 212 that are elongate parallel to the axis 104 when the assembly 100 is assembled. The beams 210, 212 can be constructed from one or more suitably rigid, corrosion resistant materials, such as coated aluminum and/ or steel. Components of the lift subassemblies can be made of galvanized steel, stainless steel, marine-grade aluminum, metal alloys (e.g., 6061T6, 6005T5), polymers (e.g., nylatron nylon, fiber Kevlar, Nomex, etc.), and the like. In addition, component of the lift subassemblies can be coated with an acrylic or non-acrylic polymeric coating to protect against marine conditions including salt water, biofilms, rust, and rain.

The lift subassembly 124 includes a motor subassembly 216, a cable winding shaft 214 (also referred to herein as, simply, a shaft), two spooling subassemblies 224, and one or more bearing blocks 300 separate from the spooling subassemblies 224.

Each spooling subassembly 224 includes one or more bearing blocks 300 (in the depicted example each subassembly 224 includes two bearing blocks 300), a spool 230, a cable retaining plate 400, and a spool guide subassembly 229 that includes a plate 226 and a rod 228.

The motor subassembly 216 includes an electrical motor 218, a drive shaft 220, and a mounting bracket 222.

The beams 210 and 212 are secured to each other via the bearing blocks 300. Fasteners 232 extend through the beams 210 and 212 into the bodies of the bearing blocks 300, thereby securing the beams 210, 210 and the bearing blocks together. The shaft 214 is received in the shaft receivers of the bodies of the bearing blocks 300. The shaft 214 is elongate parallel to the axis 104 when the assembly 100 is assembled. The central longitudinal axis defined by the shaft 214 is a rotation axis about which the shaft 214 rotates when the motor is driving rotation.

Each spool 230 is mounted over the shaft 214 and fixed to the shaft so that the spools 230 rotate together with the shaft 214. Each spool 230 is positioned between a pair of bearing blocks 300. In some examples, the spools 230 can include grooves 231 that are elongate generally perpendicular to the rotation axis or one or more grooves that spiral around the rotation axis. Such grooves can improve winding of the cables onto the spools and minimize slippage of the cables as they are being wound or unwound.

Each cable retaining plate 400 is secured with fasteners to tops of a pair of the bearing blocks 300. The cable retaining plate 400 can help to maintain cable windings evenly distributed along the rotation axis of the corresponding spool 230. Each cable retaining plate 400 defines a cutout that serves as a guide channel 401 between opposing stops 403, 405 of the guide channel 401.

The spool guide subassembly 229 includes a plate 226 that sits atop the beams 210 and 212. The rod 228 is secured to the plate 226 with a nut 249 and extends downward from a bottom surface of the plate 226 and through the guide channel 401. In some examples, the rod 228 includes a non-round horizontal cross-sectional profile, e.g., a hexagonal cross-sectional profile with one or more flat surfaces configured to contact the cable windings on the corresponding spool 230. The spool guide subassembly can slide forwards and backwards between the opposing stops 403, 405 as cable is being wound onto or unwound from the corresponding spool 230, to thereby help maintain cable windings evenly distributed along the rotation axis of the corresponding spool 230, minimize bunching of cable windings slippage of the cables as they are being wound or unwound, and the like.

In other examples, the plate 226 is fastened to the cable retaining plate 400 and/or the beams 210, 212 and thereby not able to slide within the guide channel 401.

The drive shaft 220 is coupled to the motor 218. The motor can be, e.g, an electrical motor, such as direct current (DC) motor. In some examples, the motor 218 is a 24 Volt DC motor with a gear box. In other examples, the motor 218 is replaced with a manual winding mechanism, such as a crank. The motor 218 drives rotation of the drive shaft 220 via its gear box, which is coupled to the shaft 214 (e.g., with fasteners 239) and thereby drives rotation of the shaft 214 about its rotation axis. The motor 218 can run in forward mode or reverse mode depending on whether cables are being wound on to the spools 230 or unwound from the spools 230.

The motor 218 can include its own integrated power source, e.g., a battery. Alternatively, power can be supplied by an external power source that is electrically connected to the motor 218 with one or more wires.

Via one or more wires and/or via a wireless communications network, the motor 218 (and both motors 218 when the assembly 100 includes two motors) can be controlled by a controller. The controller can be internal to the motor(s) and/or external to the motor(s). An interface (not shown) (e.g., one or more soft or hard buttons, a graphical display, a touch screen, etc.) external to the motor(s) 218 can be in operative communication with the controller to control operation of the motor(s) 218, e.g., to operate the motor to rotate the shaft(s) 214 to lift a boat or lower a boat and stop lifting or lowering a boat at a desired position. In some examples, the interface is mounted to the frame 120. In some examples, the interface is powered by the same power supply as the motor(s) 218. In some examples, the interface is powered by its own dedicated power supply.

Referring to FIGS. 11-22, the bearing blocks 300 will now be described in greater detail.

Each bearing block 300 includes a bearing block body 302, a cover plate 304, and a grease fitting 306.

The bearing block body 302 defines a recess 308 having an opening 310 at a top 311 of the bearing block body 302. The recess 308 is configured to receive a cable winding shaft 214 at a bottom 312 of the recess 308.

The bearing block plate (or cover plate) 304 is configured to be fastened to the top 311 of the bearing block body 302 with fasteners 314 extending through the cover plate 304 into fastener receivers 316 extending downward from open ends positioned at top surfaces 318, 320 of the bearing block body 302.

The bearing block plate 304 includes a flat bottom surface 322 (which can be identical to its top surface 324 that faces away from the bottom surface 322). The bottom surface 322 is configured to face the bottom 312 of the recess 308 and cover the opening 310 when the bearing block plate 304 is fastened to the bearing block body 302 with the fasteners 314.

At the left side and the right side of the bearing block body 302, the bearing block body defines one or more holes 326 for receiving fasteners to fasten the bearing block body 302 to the beams 210, 212.

In some examples, as shown, the recess 308 is U-shaped and includes a concave bottom surface 328, with opposing flat vertical (or slightly outwardly oblique but nearly vertical) surfaces 330 and 332 extending upward from opposite ends of the concave bottom surface 328.

The surface 328 defines, at the bottom 312 of the recess 308 a grease valley 334. The grease valley 334 is in fluid communication with a grease reservoir 336 which can be plugged via a hole 338 extending upward from the bottom surface of the block body 302 into the block body 302, with the grease fitting 306. The grease fitting 306 defines an internal channel 340 in fluid communication with the grease valley 334.

Because the grease valley 334 is at the bottom of the recess 308, to drain the grease valley 334 and the grease reservoir 336 of grease, the grease fitting 306 can simply be removed from the block body 302 and allowed to drain via gravity.

The grease valley 334 is configured to collect grease deposited on the shaft 214 as the shaft 214 rotates within the recess 308, and then distribute to the grease about the shaft 214 as the shaft rotates. In the example shown, the grease valley 334 has substantially the shape of a line. Other shapes for the grease valley are possible, such as an X shape.

The grease fitting 306 includes an interface 350 for mounting, e.g., a grease gun or other device capable of injecting grease into the internal channel 340 via the check valve 354 positioned at a bottom of the internal channel 340. In this manner, grease supplied to the shaft 214 can be replenished in the grease valley 334 by injection of grease from the bottom of the bearing block 300 into the internal channel 340, rather than from a top or side of the bearing block 300. Access to the bottom of the bearing block 300 may be easier than access to a side or top of the bearing block while the assembly 100 is assembled, and thus the positioning of the grease fitting 306 at the bottom of the block body 302 can advantageously facilitate grease replenishment to the shaft 214.

Figure 12:
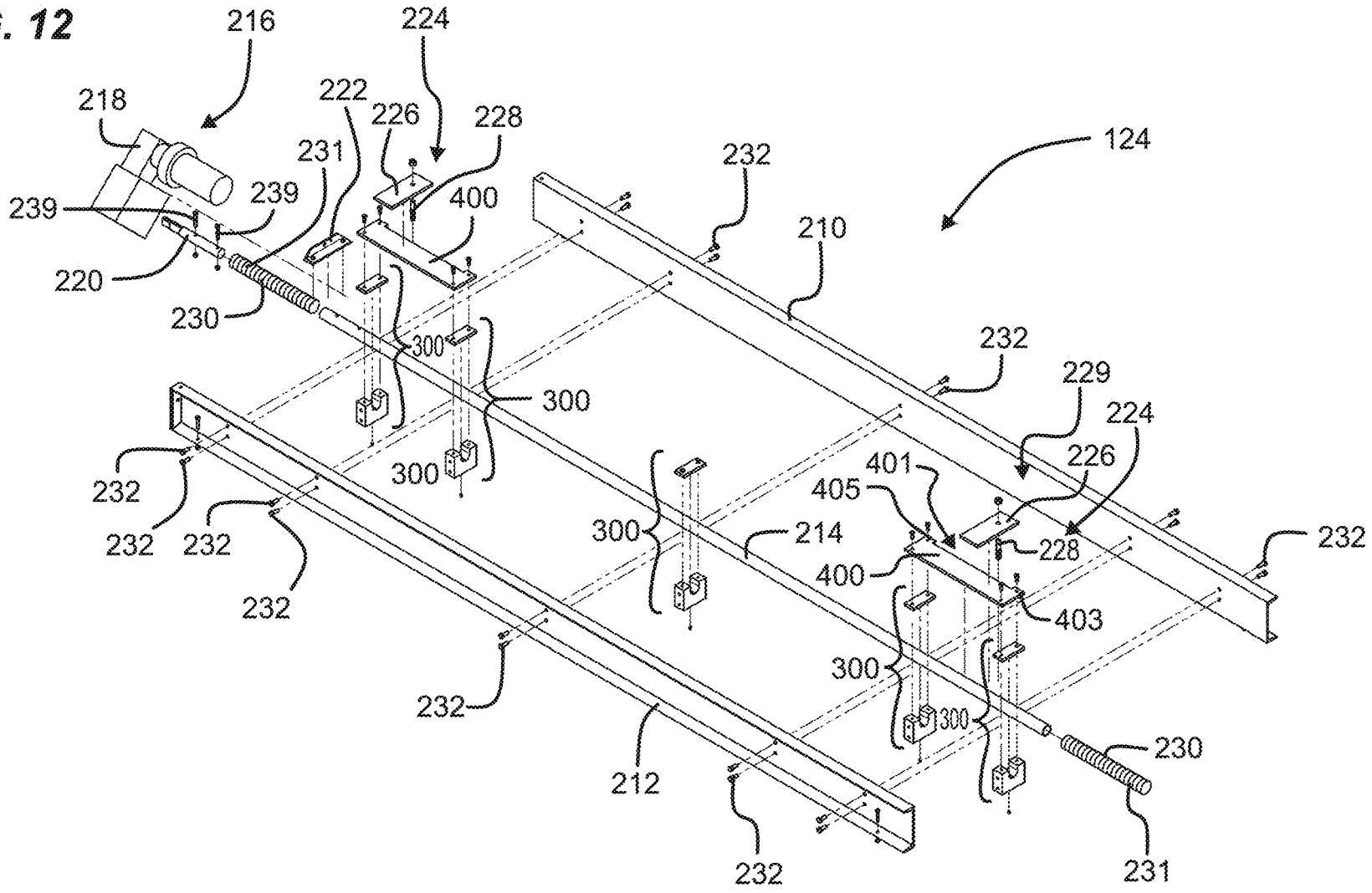
FIG. 12 is a partially exploded view of the lift subassembly of FIG. 11.
Figure 13:
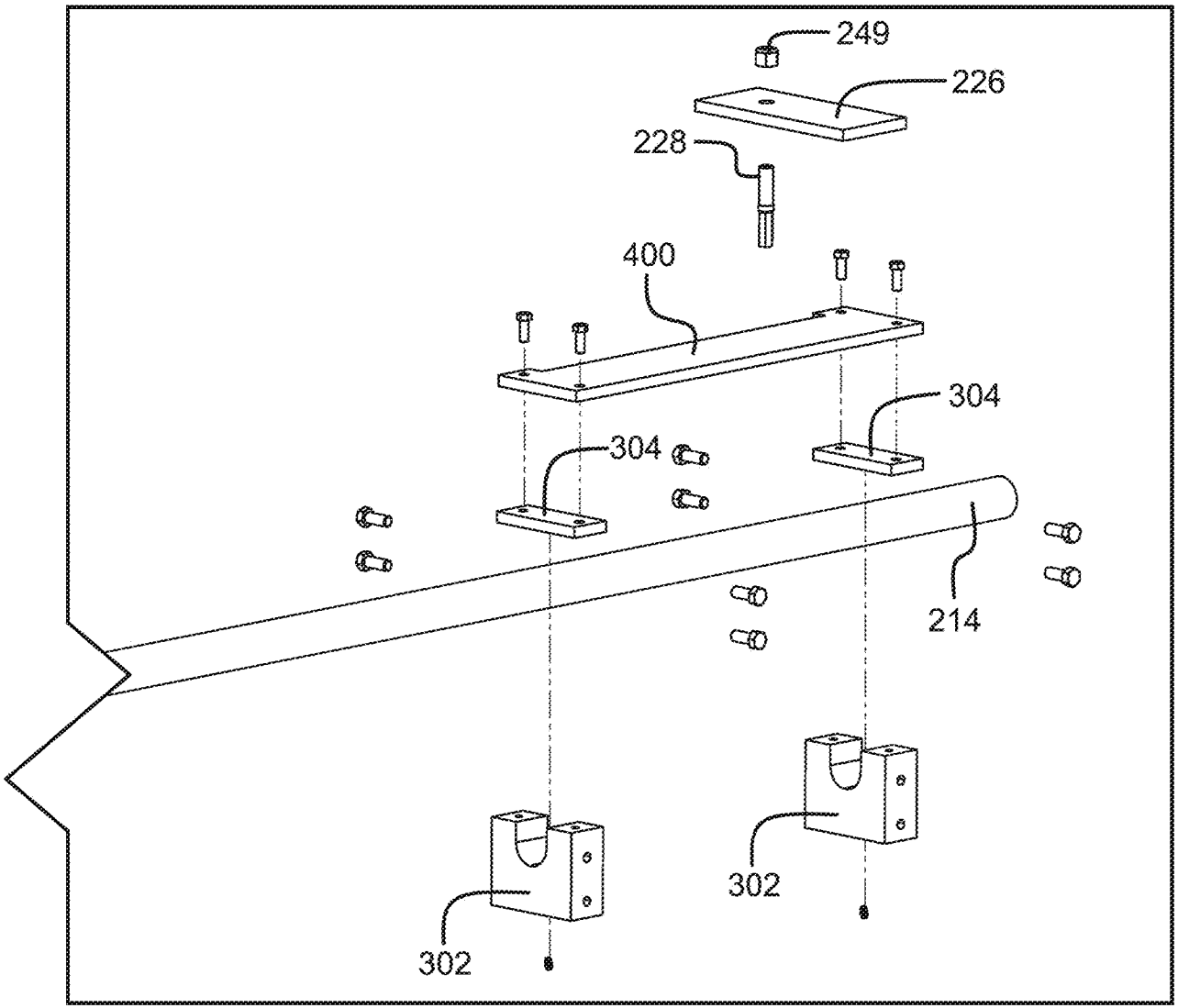
FIG. 13 is an exploded view of a portion of the lift subassembly of FIG. 11.
Figure 14:
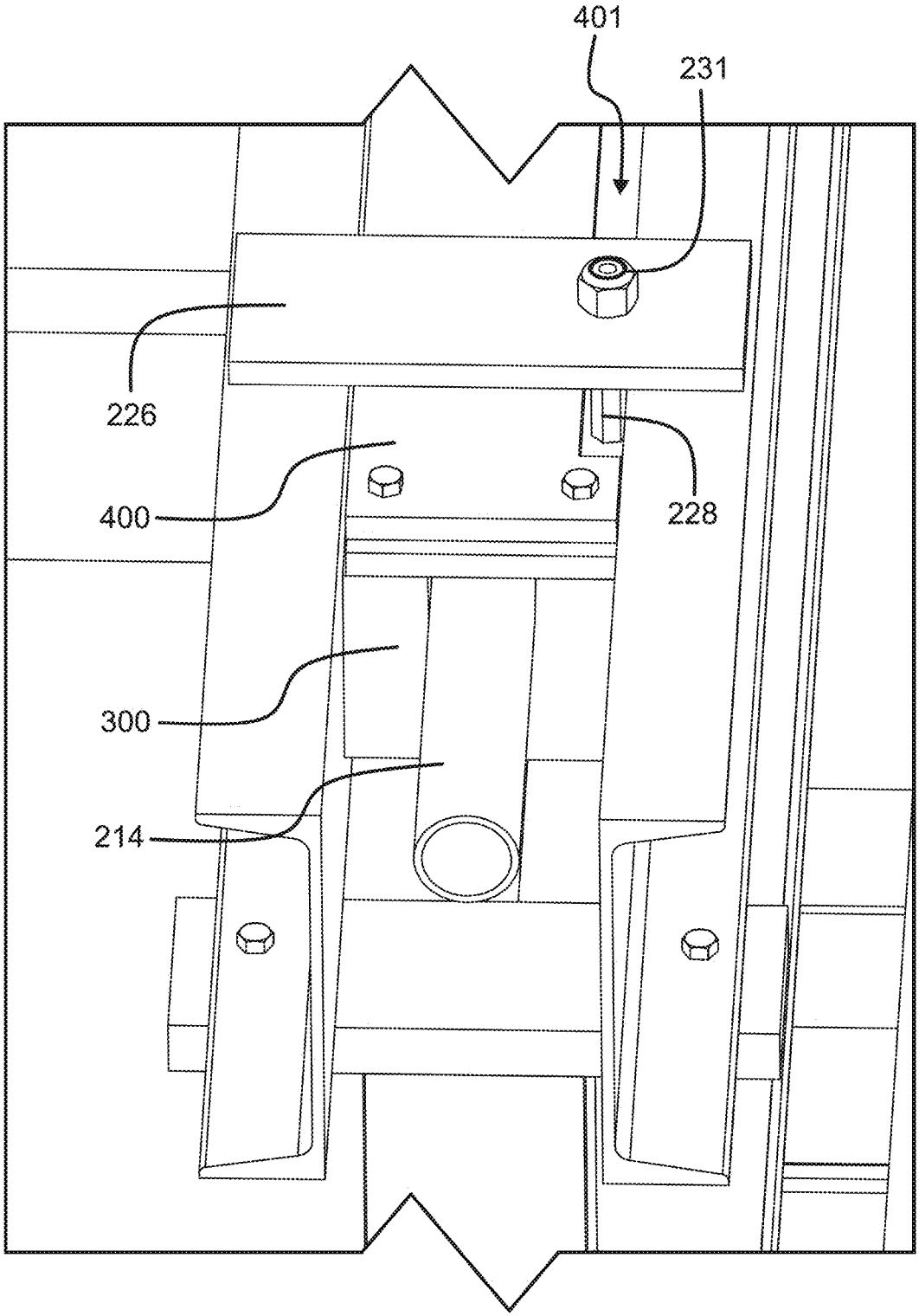
FIG. 14 is an enlarged view of a portion of the assembly of FIG. 2.
Figure 15:
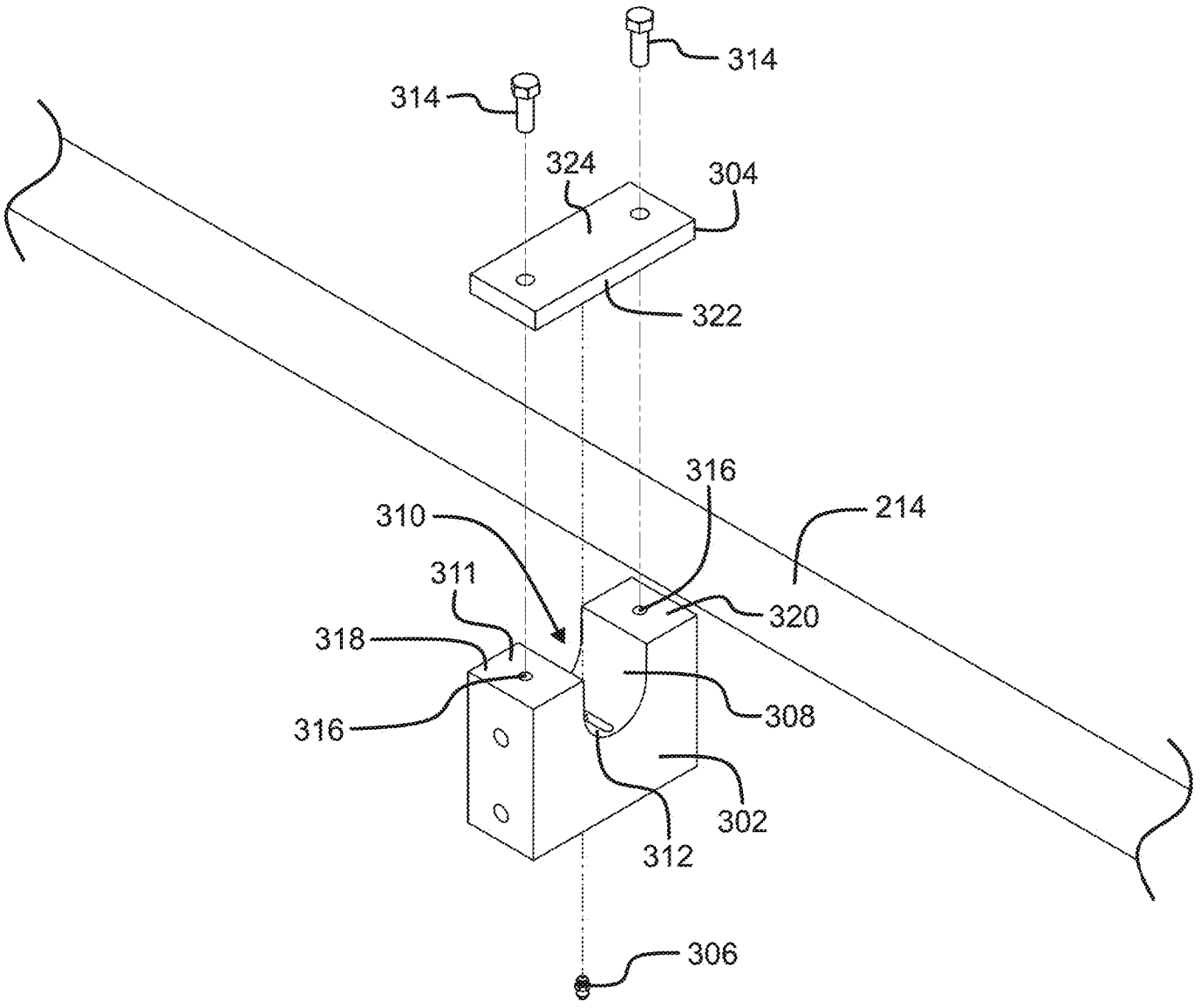
FIG. 15 is an exploded view of a portion of the lift subassembly of FIG. 11.
Figure 16:
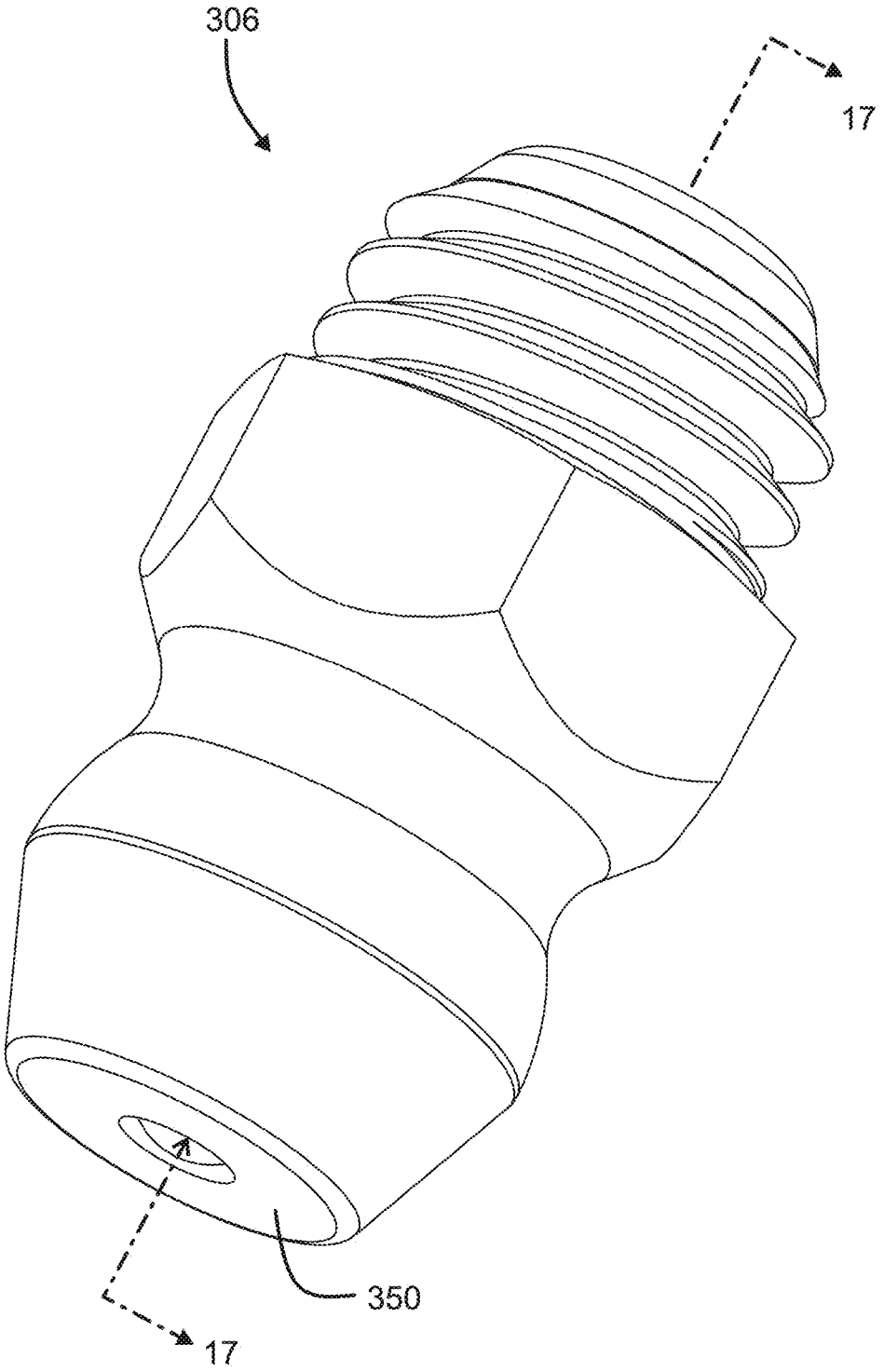
FIG. 16 is an enlarged view of the grease fitting of the portion of the lift subassembly of FIG. 15.
Figure 17:
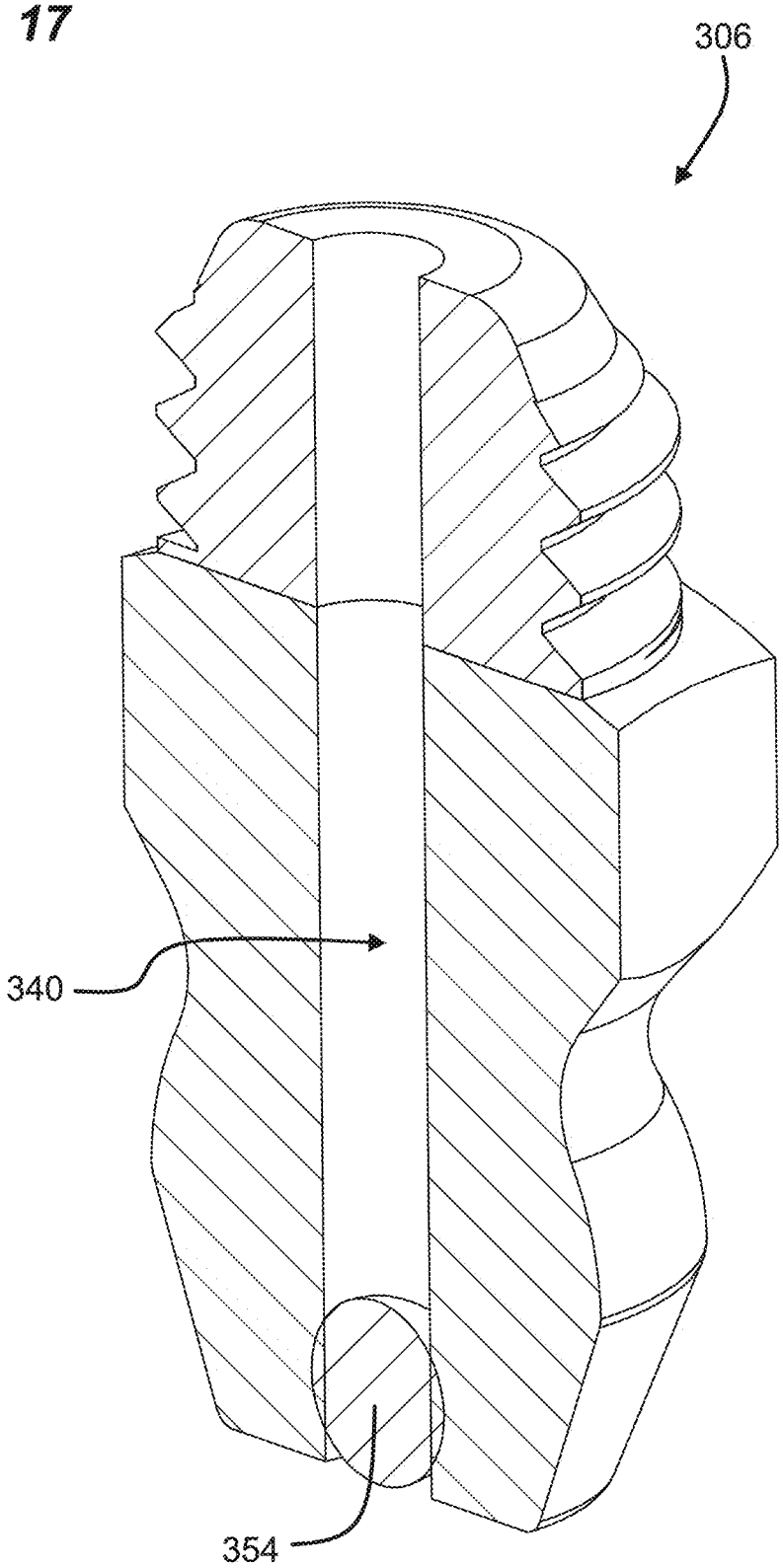
FIG. 17 is a cross-sectional view of the grease fitting of FIG. 17 taken along the line 17-17 in FIG. 16.
Figure 18:
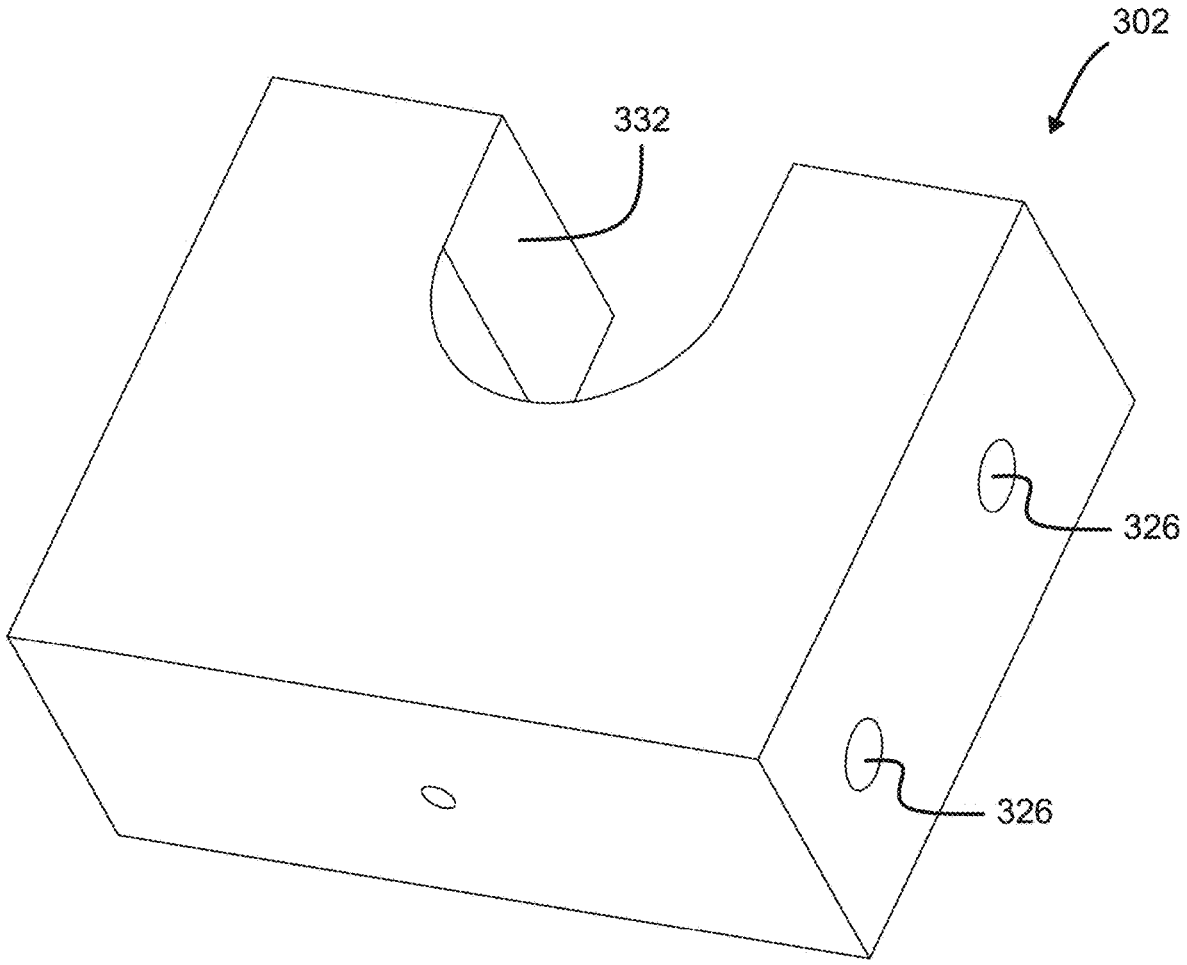
FIG. 18 is a perspective view of a bearing block body of a bearing block of the assembly of FIG. 2.
Figure 19:
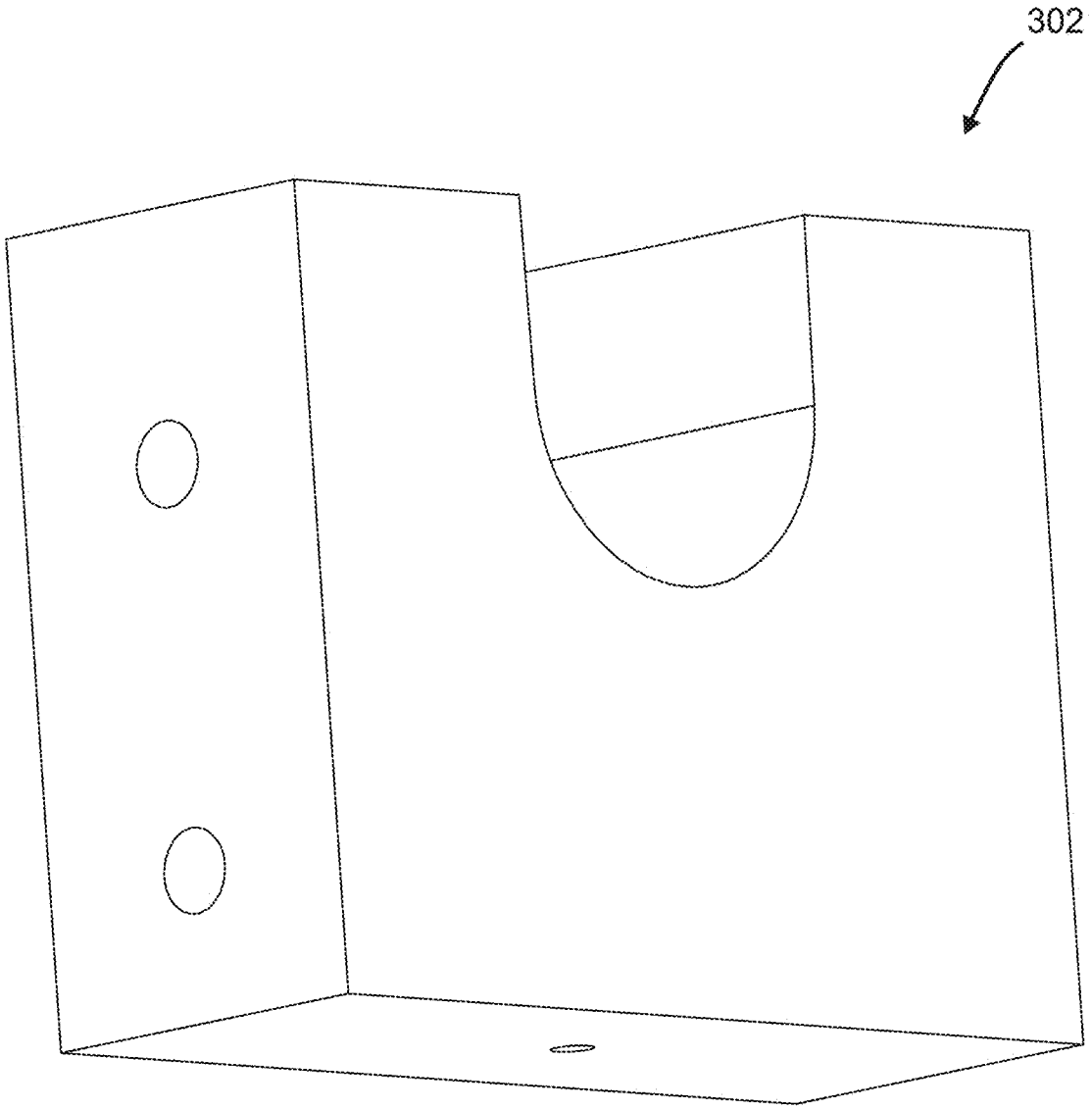
FIG. 19 is a further perspective view of the bearing block body of FIG. 18.
Figure 20:
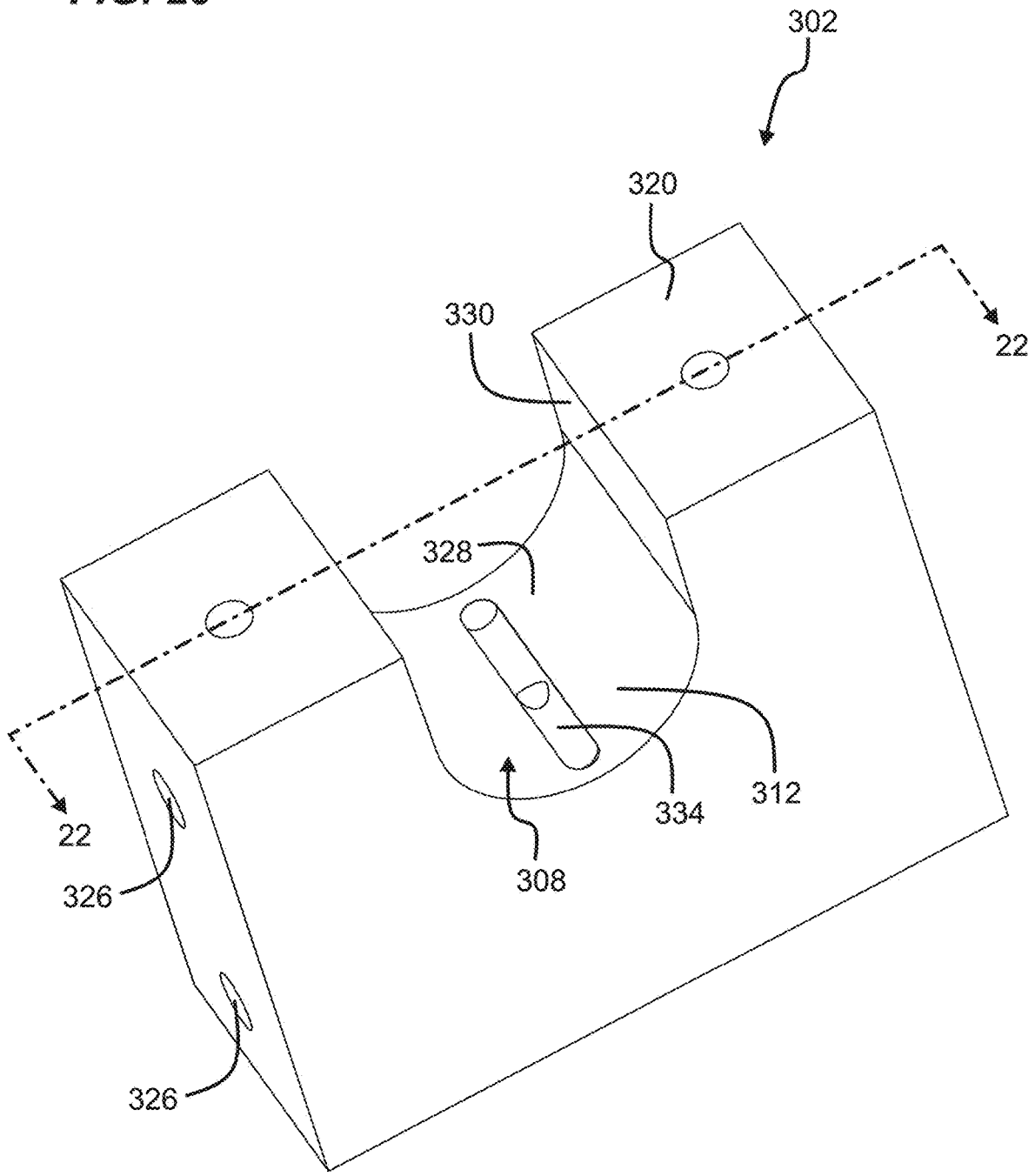
FIG. 20 is a further perspective view of the bearing block body of FIG. 18.
Figure 21:
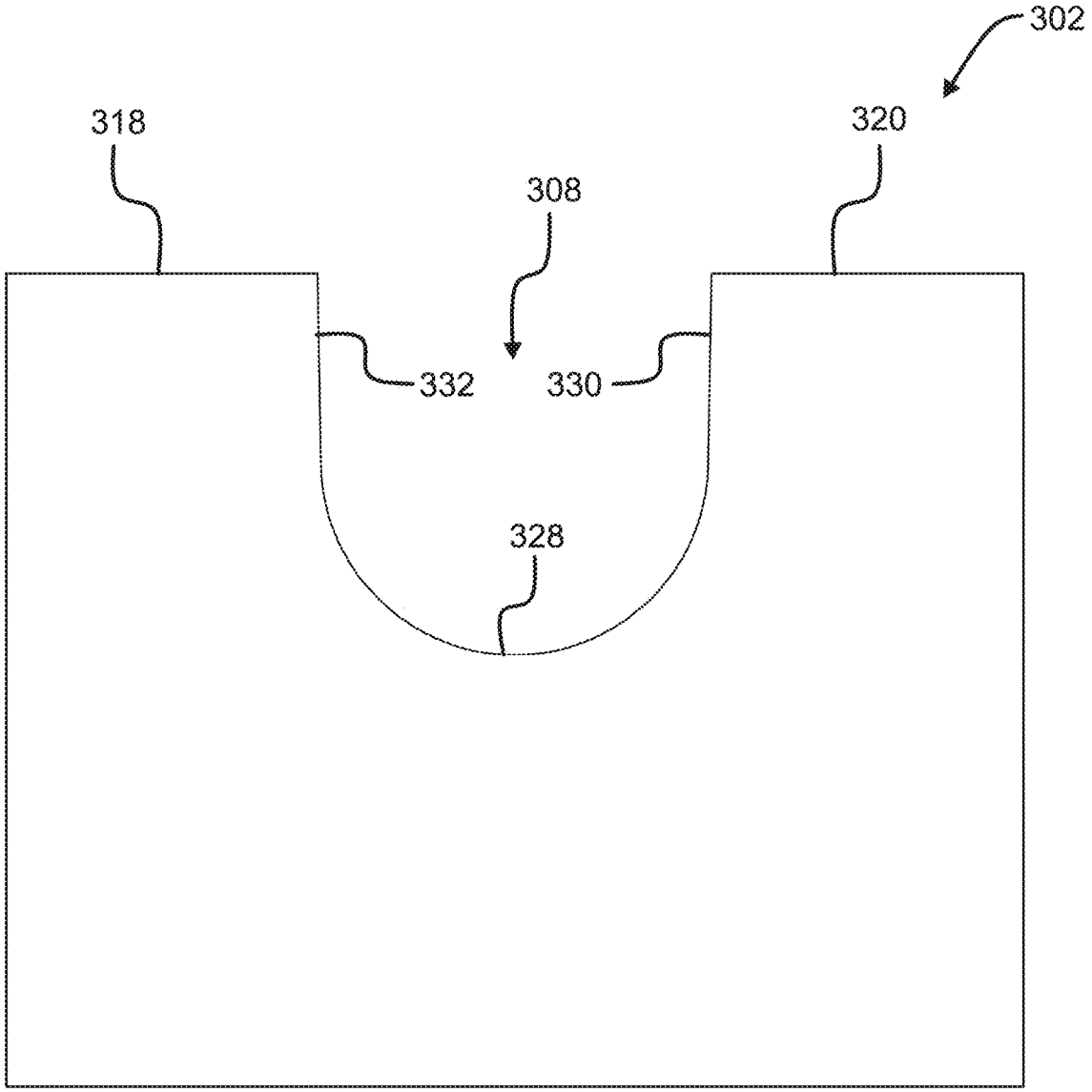
FIG. 21 is an end view of the bearing block body of FIG. 18.
Figure 22:
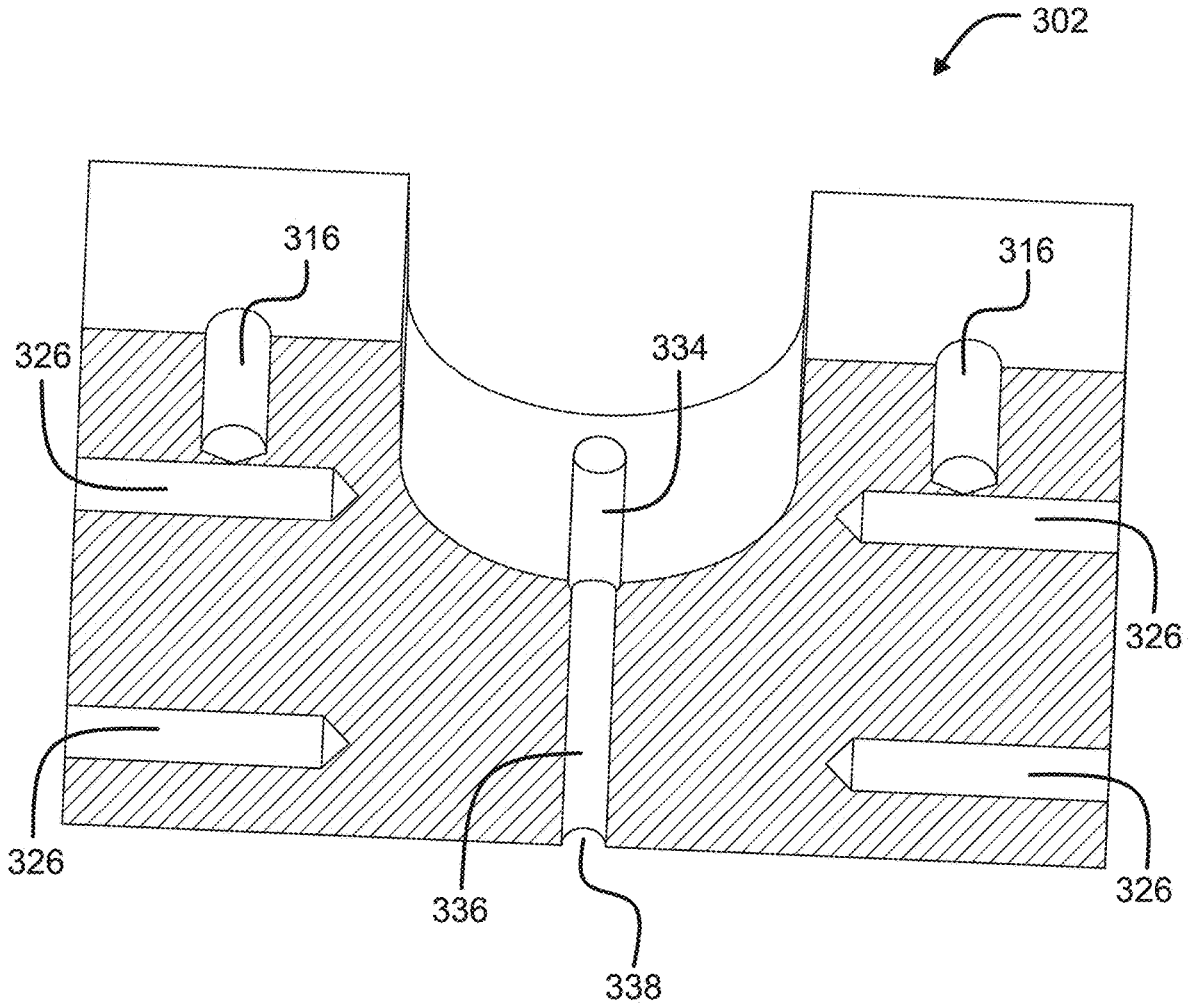
FIG. 22 is a cross-sectional perspective view of the bearing block body of FIG. 18 taken along the line 22-22 in FIG. 20.

Referring to FIGS. 12-13, example advantages of the bearing blocks 300 will now be described. Rather than being single pieces, and rather than being pieces welded to the beams 210 and 212, each bearing block 300 includes two separable parts (the block body 302 and the cover plate 304) that are fastenable together with fasteners and can be taken apart by removing the fasteners. In addition, the block body 302 can be fastened to the beams 210 and 212 with fasteners and removed from the beams 210 and 212 by removing the fasteners.

Thus, for example, if a problem arises with a specific bearing block 300, that bearing block 300 can be removed from the lift subassembly 124, 126 (for repair, maintenance, replacement, and so forth), without disturbing other components of the lift subassembly, such as the shaft 214, the spool 230, the beams 210, 212, or other bearing blocks 300. In contrast, according to the system of FIG. 1, the entire lift subassembly would have to be replaced if one of the bearing blocks stops functioning properly.

As another example, if a problem arises with the shaft 214, a spool 230, or a cable, the plate 226, the retaining plate 400, and the bearing block cover plate 304 of each bearing block 300 are simply unfastened and removed from the lift subassembly 124, 126, and the shaft 214, cables, and spools 230 can simply be lifted out of the bearing block bodies 302 to perform, e.g., maintenance, replacement, repair, and so forth on the shaft, the spool, the cables, and the like, without disturbing other components of the lift subassembly, such as the beams 210, 212 or the bearing block bodies 302.

As another example, installation of the shaft 214 and the spools 230 when assembling the lift subassembly 124, 126 can be simplified and facilitated. An assembly of the shaft and the spools can simply be lowered into the U-shaped receivers of the block bodies 302 that are already fastened to the beams 210 and 212, and then covered by cover plates 304 (and, in some examples also the retaining plates 400 and/or the plates 226) rather than, for example, carefully positioning and holding the spools in position between pairs of bearing blocks and then axially feeding the shaft through the spools and all of the fully assembled bearing blocks.

The U-shaped receivers of the bearing block bodies 302 receive the entire diameter of the shaft 214, which can further facilitate installation, removal and repair of components of the lift subassembly 124, 126 as compared with e.g., a split bearing block consisting of two semicircular bodies each of each which bodies receives a portion of the diameter of the shaft.

Figure 23:
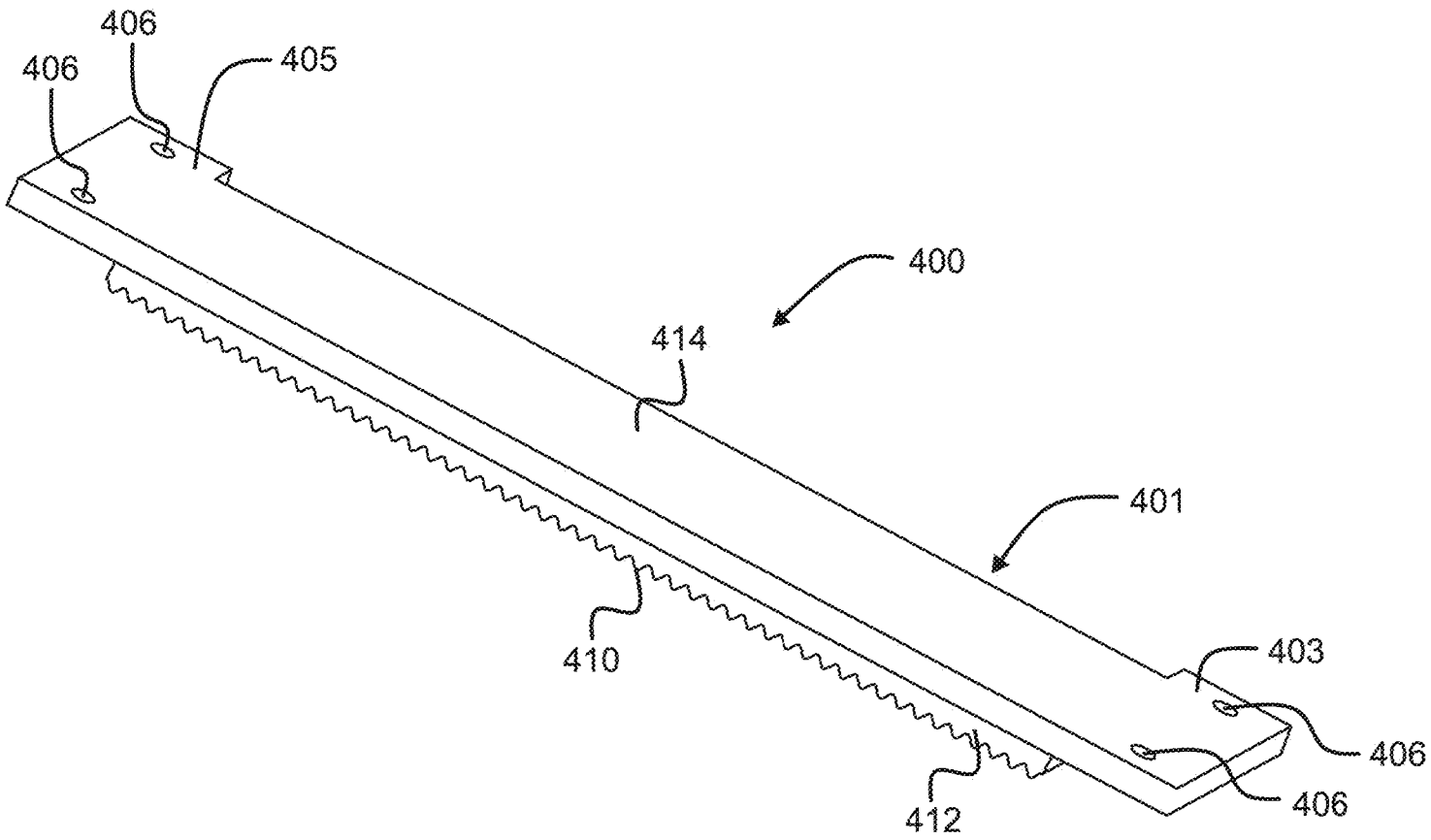
FIG. 23 is a perspective view of an embodiment of a cable retaining plate that can be used with the assembly of FIG. 2.
Figure 24:
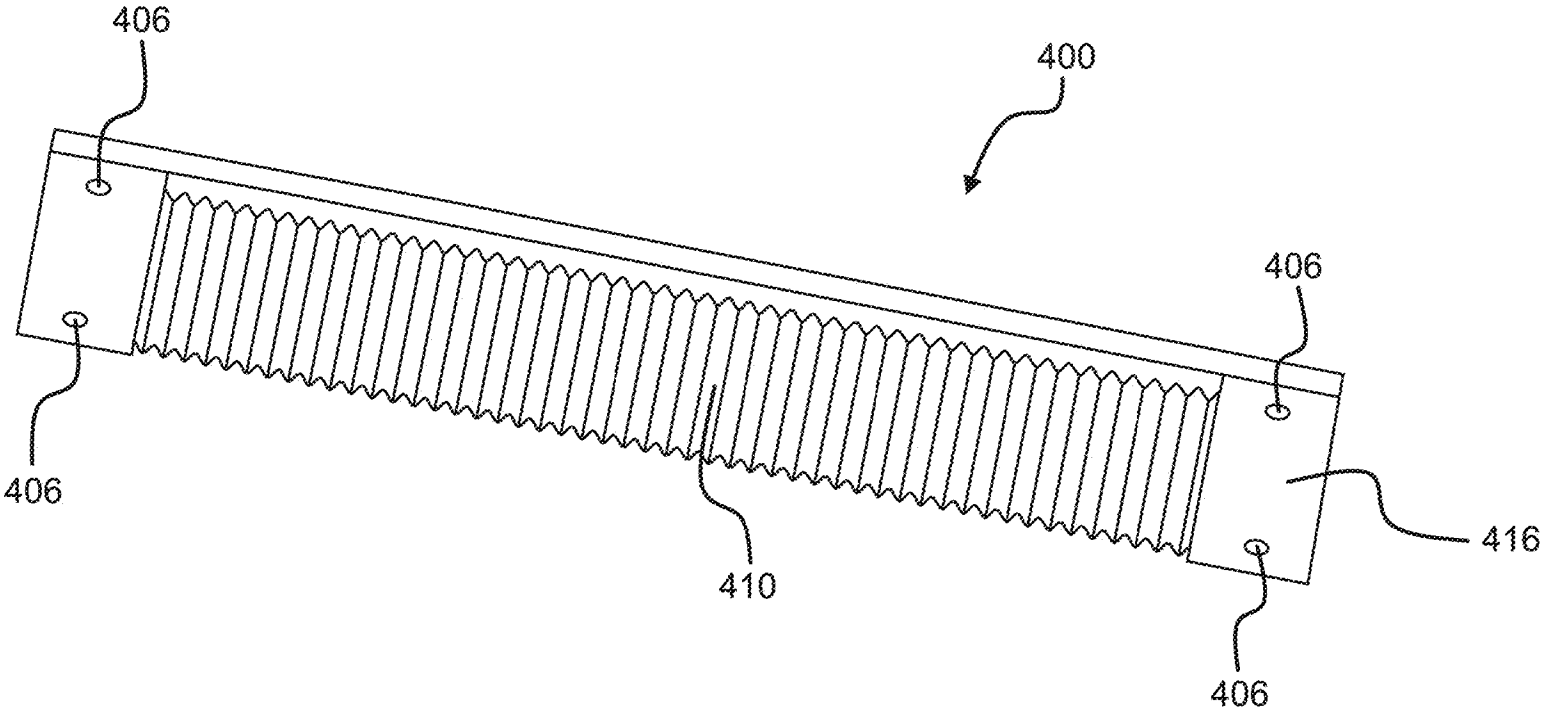
FIG. 24 is a further perspective view of the cable retaining plate of FIG. 23.

FIG. 23 is a perspective view of an embodiment of a cable retaining plate 400 that can be used with the assembly of FIG. 2. FIG. 24 is a further perspective view of the cable retaining plate 400 of FIG. 23.

Referring to FIGS. 11-14 and 23-24, the cable retaining plate 400 is configured to be fastened, with fasteners installed through holes 406 defined by the cable retaining plate 400 to the tops of a pair of spaced apart (along the shaft rotation axis) bearing block cover plates 304 such that the cable retaining plate 400 spans an axial distance between the bearing blocks 300 and extends along the cable winding shaft beyond each bearing block cover plate 304.

The cable retaining plate 400 defines a cutout that serves as a guide channel 401 elongate parallel to the rotation axis of the shaft and extending between opposing stops 403, 405 of the guide channel 401 defined by the cable retaining plate, as described above.

In some examples, the cable retaining plate 400 includes a grooved surface 410. In some examples, the grooved surface 410 is provided by a grooved body 412 that is mounted to a bottom surface 416 of a body 414 of the cable retaining plate 400. The grooved body 412 can be, e.g., constructed of a rigid polymeric material that defines grooves. The grooved surface 410 can include grooves that are elongate generally perpendicular or slightly obliquely to the rotation axis of the shaft. Such grooves can improve winding of the cables onto the spools and minimize slippage of the cables as they are being wound or unwound.

Example Embodiments

According to a first example embodiment, an adjustable boat lift apparatus includes: a support beam positioned horizontally over two frame towers, the support beam comprising: one or more load-bearing blocks spaced along a length of the support beam and comprising a first part rigidly fastened to the support beam and a second part configured to be fastened to the first part of a respective load-bearing block; and a cable winding shaft (also referred to herein as an output shaft) comprising one or more cable spools (also referred to herein as cable winders), the output shaft positioned over the first part of the one or more load-bearing blocks, wherein the one or more load-bearing blocks are configured to fit the output shaft and one or more cable winders within the first part.

According to a second example embodiment, there is provided the first example embodiment, wherein the first part of the one or more load-bearing blocks comprises a grease valley (also referred to herein as a grease reservoir) positioned on an internal surface of the first part of the load-bearing block.

According to a third example embodiment, there is provided the first example embodiment, wherein the support beam further comprises a motor connected to a gearbox.

According to a fourth example embodiment, there is provided the first example embodiment, further including a frame base positioned between four or more frame towers and defining a horizontal plane, wherein the frame base is movable along a vertical axis between a foot of a respective frame tower and the support beam.

According to a fifth example embodiment, there is provided the fourth example embodiment, wherein the frame base is connected by two or more cables configured to wind around cable spools of the output shaft when the frame base is moved from a first position near the feet of the frame towers to a second position near the support beam.

According to a sixth example embodiment, an adjustable boat lift apparatus includes frame towers, each frame tower comprising a foot at a first end and connected to a support beam on a second end, the support beam connected to at least two frame towers; and a frame base positioned between four or more frame towers and defining a horizontal plane; wherein the frame base is movable along a vertical axis between the feet of the frame towers to the support beam.

According to a seventh example embodiment, there is provided the sixth example embodiment, further including two or more cables connecting the frame base to an output shaft positioned in the support beam, the two or more cables configured to wind around cable winders along the output shaft to thereby move the frame base from a first position near the feet of the frame towers to a second position near the support beam.

According to an eighth example embodiment, there is provided the sixth example embodiment, wherein each frame tower is adjustable along the vertical axis.

According to a ninth example embodiment, there is provided the sixth example embodiment, wherein opposing frame towers connected to via the support beam are configured to be adjusted such that the frame base is made larger or smaller.

According to a tenth example embodiment, there is provided the sixth example embodiment, wherein the frame base further comprises a boat cradle positioned central within the frame base.

According to an eleventh example embodiment, there is provided the tenth example embodiment, wherein the boat cradle comprises a slidable cradle support such that the boat cradle can fit boats of different sizes.

According to a twelfth example embodiment, there is provided the sixth example embodiment, wherein the support beam further comprises: one or more load-bearing blocks spaced along a length of the support beam and comprising a first part rigidly fastened to the support beam and a second part configured to be fastened to the first part of a respective load-bearing block; and an output shaft comprising one or more cable winders, the output shaft positioned over the first part of the one or more load-bearing blocks, wherein the one or more load-bearing blocks are configured to fit the output shaft and one or more cable winders within the first part.

According to a thirteenth example embodiment, a method of manufacturing a boat lift apparatus includes: providing a support beam; fastening, to the support beam, a first part of a load-bearing block comprising a U-shaped internal surface configured to fit an output shaft; positioning the output shaft within the first part of the load-bearing block; and fastening a second part of the load-bearing block to the first part and over the output shaft.

According to a fourteenth example embodiment, there is provided the thirteenth example embodiment, further including forming a grease valley on the U-shaped internal surface.

According to a fifteenth example embodiment, there is provided the thirteenth example embodiment, further including adding an additional load-bearing block by: sliding the first part of the additional load-bearing block around the output shaft; fastening the first part of the additional load-bearing block to the support beam; and fastening the second part of the additional load-bearing block to the first part and over the output shaft.

According to a sixteenth example embodiment, there is provided the thirteenth example embodiment, further including replacing a respective load-bearing block by: removing the second part of the load-bearing block; unfastening the first part of the load-bearing block; and sliding the first part of the load-bearing block away from the output shaft.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

What is claimed is:

1. An assembly for a boat lift, comprising:

a frame, the frame extending from a bottom of the frame to a top of the frame parallel to a vertical axis, the frame including:

four vertical members elongate parallel to the vertical axis, the vertical members including a first pair of vertical members and a second pair of vertical members; and four horizontal members elongate perpendicular to the vertical axis and coupled to the vertical members;

a beam elongate perpendicular to the vertical axis and attached to two of the vertical members, the beam being positioned above the four horizontal members relative to the vertical axis;

a cable winding shaft elongate perpendicular to the vertical axis and rotatable relative to the beam; and a cradle coupled to the cable winding shaft and configured, by rotation of the cable winding shaft, to move up and down parallel to the vertical axis and relative to the frame, the cradle including a first pair of cradle members elongate perpendicular to the vertical axis, wherein the first pair of vertical members and the second pair of vertical members are adjustably coupled to two of the four horizontal members to adjust a spacing between the first pair of the vertical members and the second pair of the vertical members.

2. The assembly of claim 1, further comprising:

a bearing block attached to the beam, where the cable winding is received with the bearing block;

another beam elongate perpendicular to the vertical axis and coupled to the vertical members;

another bearing block attached the another beam; and another a cable winding shaft elongate perpendicular to the vertical axis received in the another bearing block and rotatable relative to the another beam, wherein the cradle is coupled to the another cable winding shaft.

3. The assembly of claim 2, further comprising cables coupling the cradle to the cable winding shaft and the another cable winding shaft.

4. The assembly of claim 3, further comprising:

a first motor attached to the beam and configured to drive the rotation of the cable winding shaft; and a second motor attached to the beam configured to drive rotation of the another cable winding shaft.

5. The assembly of claim 1, further comprising four feet positioned at bottom ends of the four vertical members, the four feet being configured to rest on a bed or a floor of a body of water.

6. The assembly of claim 1, further comprising a motor attached to the beam and configured to the drive rotation of the cable winding shaft.

7. The assembly of claim 1, wherein the cradle includes a second pair of cradle members and a third pair of cradle members elongate perpendicular to the vertical axis, the second pair of cradle members being elongate perpendicular to elongate dimensions of the first pair of cradle members, the third pair of cradle members being elongate parallel to elongate dimensions of the first pair of cradle members; and wherein the first pair of cradle members are adjustably coupled to the second pair of cradle members to adjust a spacing between the first pair of cradle members.

8. The assembly of claim 7, further comprising a cable coupled to the cable winding shaft and to one of the first pair of cradle members.

9. The assembly of claim 1, further comprising:

a bearing block attached to the beam, where the cable winding shaft is received in the bearing block, the bearing block including:

a bearing block body defining a U-shaped recess that is open at a top of the bearing block body; and a bearing block plate configured to be fastened to the top of the bearing block body.

10. The assembly of claim 9, wherein the bearing block body includes a grease valley defined by a surface of the U-shaped recess at a bottom of the U-shaped recess.

11. The assembly of claim 9, further comprising a grooved cable retaining plate attached to the bearing block plate.

12. The assembly of claim 1, further comprising:

a pair of guides mounted to the cradle configured to center a watercraft on the cradle.

13. A kit of parts for a boat lift, comprising:

eight elongate members;

an elongate beam;

an elongate cable winding shaft;

a cable; and a boat cradle, wherein the kit is configured to be assembled as an assembly of the boat lift that includes:

a frame including the eight elongate members, the frame extending from a bottom of the frame to a top of the frame parallel to a vertical axis, the frame including:

four of the elongate members positioned to be elongate parallel to the vertical axis to define a first pair of vertical members and a second pair of vertical members;

another four of the elongate members positioned to be perpendicular to the vertical axis and coupled to the vertical members;

where the first pair of vertical members and the second pair of vertical members being adjustably coupled to at least two of the four horizontal members to adjust a spacing between the first pair of the vertical members and the second pair of the vertical members;

the beam positioned to be elongate perpendicular to the vertical axis and above the four horizontal members relative to the vertical axis, the beam being attached to the first pair of vertical members or to the second pair of vertical members;

the cable winding shaft positioned to be elongate perpendicular to the vertical axis, and rotatable relative to the beam; and the boat cradle being coupled to the cable winding shaft with the cable such that the cradle can move, by rotation of the cable winding shaft, up and down parallel to the vertical axis and relative to the frame.

14. A method of assembling a boat lift, comprising:

assembling the parts of the kit of claim 13 by:

assembling the frame;

attaching the beam to the frame;

attaching a bearing block to the beam; and positioning the cable winding shaft in the bearing block; and coupling the boat cradle to the cable winding shaft with a cable.

15. The kit of claim 13, further comprising:

a pair of guides mounted to the cradle configured to center a watercraft on the cradle.

16. The kit of claim 13, further comprising:

a bearing block attached to the beam, wherein the cable winding shaft is received within the bearing block.

17. A kit of parts for a boat lift, comprising:

eight elongate members;

an elongate beam;

coupling members; and a boat cradle;

wherein the kit is configured to be assembled as an assembly of the boat lift that includes:

a frame including the eight elongate members, and the coupling members, the frame extending from a bottom of the frame to a top of the frame parallel to a vertical axis, the frame including:

four of the elongate members positioned to be elongate parallel to the vertical axis to define a first pair of vertical members and a second pair of vertical members;

another four of the elongate members positioned to be perpendicular to the vertical axis and coupled to the vertical members; and the coupling members being positioned to adjustably couple at least the first pair of the vertical members or the second pair of the vertical members to two of the four horizontal members to adjust a spacing between the first pair of the vertical members and the second pair of the vertical members;

the beam positioned to be elongate perpendicular to the vertical axis and above the four horizontal members relative to the vertical axis, the beam being attached to the first pair of vertical members or to the second pair of vertical members; and the boat cradle positioned to move up and down parallel to the vertical axis and relative to the frame, the cradle including a first pair of cradle members positioned to be elongate perpendicular to the vertical axis.

18. A method of assembling a boat lift, comprising:

assembling the parts of the kit of claim 17 by:

assembling the frame;

attaching the beam to the frame;

using the coupling members to adjust the spacing; and coupling the boat cradle such that the beam supports the boat cradle.

19. The kit of claim 17, further comprising:

a pair of guides mounted to the cradle configured to center a watercraft on the cradle.

20. A kit of parts for a boat lift, comprising:

a bearing block, the bearing block including:

a bearing block body defining a recess having an opening at a top of the bearing block body and configured to receive a cable winding shaft at a bottom of the recess; and a bearing block plate configured to be fastened to the top of the bearing block body, the bearing block plate including a flat surface configured to face the bottom of the recess and cover the opening when the bearing block plate is fastened to the bearing block body.

21. The kit of claim 20, wherein the recess is U-shaped.

22. The kit of claim 20, wherein the bearing block body includes a grease valley defined by a surface of the recess at the bottom of the U-shaped recess.

23. A kit of parts for a boat lift, comprising:

a bearing block, the bearing block including:

a bearing block body defining a recess having an opening at a top of the bearing block body and configured to receive a cable winding shaft at a bottom of the recess; and a bearing block cover configured to be fastened to the top of the bearing block body, wherein the bearing block body includes a grease valley defined by a surface of the recess at the bottom of the recess.

24. The kit of claim 23, wherein the grease valley defines an X-shape.

* * * * *